US007685987B2

(12) United States Patent
Miyamoto et al.

(10) Patent No.: US 7,685,987 B2
(45) Date of Patent: Mar. 30, 2010

(54) CYLINDER LINER AND METHOD FOR MANUFACTURING THE SAME

(75) Inventors: Noritaka Miyamoto, Toyota (JP); Toshihiro Takami, Toyota (JP); Masaki Hirano, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 409 days.

(21) Appl. No.: 11/480,873

(22) Filed: Jul. 6, 2006

(65) Prior Publication Data

US 2007/0012175 A1 Jan. 18, 2007

(30) Foreign Application Priority Data

Jul. 8, 2005 (JP) ..... 2005-201002

(51) Int. Cl.

| | |
|---|---|
| ***F02F 1/00*** | (2006.01) |
| ***F02F 1/10*** | (2006.01) |
| ***F02F 3/00*** | (2006.01) |
| ***F02B 75/08*** | (2006.01) |

(52) U.S. Cl. ..... 123/193.2; 123/193.1; 123/668

(58) Field of Classification Search ... 123/193.1–193.3, 123/668; 29/888.061

See application file for complete search history.

(56) References Cited

U.S. PATENT DOCUMENTS

| | | | | |
|---|---|---|---|---|
| 4,447,275 | A * | 5/1984 | Hiraoka et al. | 148/512 |
| 5,291,862 | A | 3/1994 | Katoh et al. | |
| 5,537,969 | A * | 7/1996 | Hata et al. | 123/193.2 |
| 6,640,765 | B2 * | 11/2003 | Land et al. | 123/193.2 |

FOREIGN PATENT DOCUMENTS

| | | |
|---|---|---|
| DE | 760 193 | 6/1953 |
| DE | 19745585 | 4/1998 |
| DE | 10338386 | 12/2004 |

(Continued)

OTHER PUBLICATIONS

International Search Report, PCT/JP2006/313914 dated Dec. 15, 2006.

(Continued)

*Primary Examiner*—Stephen K Cronin
*Assistant Examiner*—Sizo B Vilakazi
(74) *Attorney, Agent, or Firm*—Kenyon & Kenyon LLP

(57) ABSTRACT

A cylinder liner for insert casting used in a cylinder block is disclosed. The cylinder liner has an outer circumferential surface, and upper, middle, and lower portions with respect to an axial direction of the cylinder liner. A high thermal conductive film is formed in a section of the outer circumferential surface that corresponds to the upper portion, and a low thermal conductive film is formed in a section of the outer circumferential surface that corresponds to the lower portion. The high thermal conductive film and the low thermal conductive film are laminated in a section of the outer circumferential surface that corresponds to the middle portion, thereby forming a laminated film portion. As a result, temperature difference along the axial direction of the cylinder is reduced.

23 Claims, 14 Drawing Sheets

FOREIGN PATENT DOCUMENTS

| | | | |
|---|---|---|---|
| DE | 103 47 510 | B3 | 4/2005 |
| EP | 1 504 833 | A1 | 2/2005 |
| JP | 62-52255 | | 4/1987 |
| JP | 2003-053506 | A | 2/2003 |
| JP | 2003-120414 | A | 4/2003 |
| RU | 2 146 183 | C1 | 3/2000 |

OTHER PUBLICATIONS

Written Opinion of the International Searching Authority, PCT/JP2006/313914.

International Preliminary Report on Patentability, PCT/JP2006/313914.

* cited by examiner

| | Basic Component |
|---|---|
| T. C | 2.9 (% by mass) to 3.7 (% by mass) |
| Si | 1.6 (% by mass) to 2.8 (% by mass) |
| Mn | 0.5 (% by mass) to 1.0 (% by mass) |
| P | 0.05 (% by mass) to 0.4 (% by mass) |

| | Auxiliary Component |
|---|---|
| Cr | 0.05 (% by mass) to 0.4 (% by mass) |
| B | 0.03 (% by mass) to 0.08 (% by mass) |
| Cu | 0.3 (% by mass) to 0.5 (% by mass) |

※T. C Represents Total Carbon

Thickness of High Thermal Conductive Portion
Thickness of Low Thermal Conductive Portion
0
25
27
26
23
21
24
22
2
51A
51C
51B
51

CYLINDER LINER AND METHOD FOR MANUFACTURING THE SAME

BACKGROUND OF THE INVENTION

The present invention relates to a cylinder liner for insert casting used in a cylinder block, and a method for manufacturing the cylinder liner.

Cylinder blocks for engines with cylinder liners have been put to practical use. Cylinder liners are typically applied to cylinder blocks made of an aluminum alloy. As such a cylinder liner for insert casting, the one disclosed in Japanese Laid-Open Utility Model Publication No. 62-52255 is known.

In an engine, a temperature increase of the cylinders causes the cylinder bores to be thermally expanded. Further, the temperature in a cylinder varies along the axial direction. Accordingly, the amount of deformation of the cylinder bore varies along the axial direction. Such variation in deformation amount of a cylinder increases the friction of the piston, which degrades the fuel consumption rate.

SUMMARY OF THE INVENTION

Accordingly, it is an objective of the present invention to provide a cylinder liner and a method for manufacturing the same that suppress temperature difference along the axial direction of a cylinder, thereby improving the fuel consumption rate.

To achieve the foregoing objectives and in accordance with a first aspect of the present invention, a cylinder liner for insert casting used in a cylinder block is provided. The cylinder liner has an outer circumferential surface, and upper, middle, and lower portions with respect to an axial direction of the cylinder liner. A high thermal conductive film is formed in a section of the outer circumferential surface that corresponds to the upper portion, and a low thermal conductive film is formed in a section of the outer circumferential surface that corresponds to the lower portion. The high thermal conductive film and the low thermal conductive film are laminated in a section of the outer circumferential surface that corresponds to the middle portion, thereby forming a laminated film portion.

In accordance with a second aspect of the present invention, a cylinder liner for insert casting used in a cylinder block is provided. The cylinder liner has an outer circumferential surface, and upper and lower portions with respect to an axial direction of the cylinder liner. A sprayed layer is formed on the outer circumferential surface. The sprayed layer is continuous from the upper portion to the lower portion. A section of the sprayed layer that corresponds to the lower portion has a thickness less than that of a section of the sprayed layer that corresponds to the upper portion.

In accordance with a third aspect of the present invention, a method for manufacturing a cylinder liner for insert casting used in a cylinder block is provided. The cylinder liner has an outer circumferential surface, and upper and lower portions with respect to an axial direction of the cylinder liner. The method includes: forming, on the outer circumferential surface, a sprayed layer that is continuous from the upper portion to the lower portion by using a spraying device; separating, when forming the sprayed layer in a section of the outer circumferential surface that corresponds to the upper portion, the spraying device from the section by a first distance; and separating, when forming the sprayed layer in a section of the outer circumferential surface that corresponds to the lower portion, the spraying device from the section by a second distance greater than the first distance, so that a section of the sprayed layer that corresponds to the lower portion has a thickness less than that of a section of the sprayed layer that corresponds to the upper portion.

BRIEF DESCRIPTION OF THE DRAWINGS

The invention, together with objects and advantages there of, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 6B.

The present embodiment relates to a case in which the present invention is applied to cylinder liners of an engine made of an aluminum alloy.

<Structure of Engine>

Figure 1:
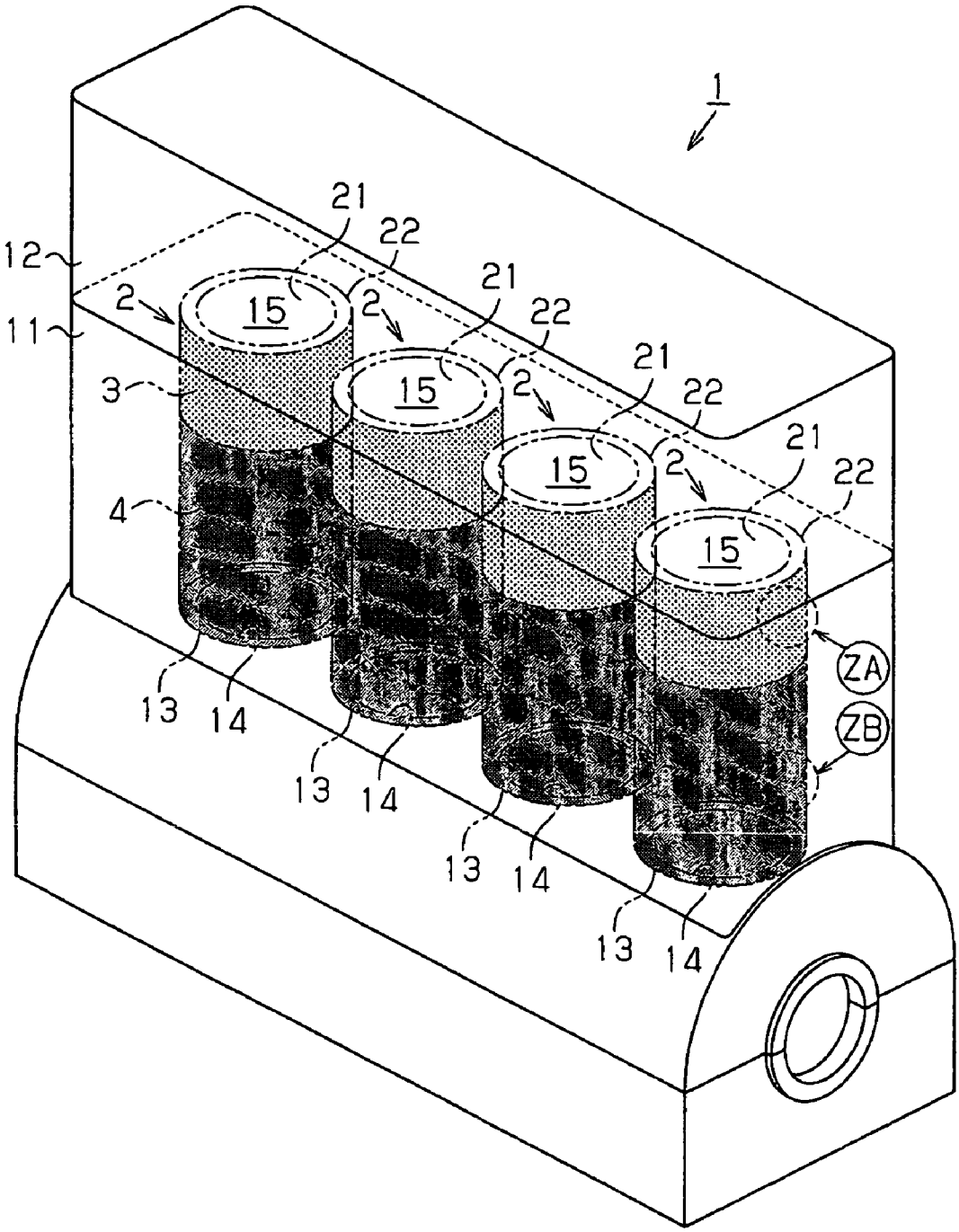
FIG. 1 is a schematic view illustrating an engine having cylinder liners according to a first embodiment of the present invention.

FIG. 1 shows the structure of an entire engine 1 having cylinder liners 2 according to the present invention.

The engine 1 includes a cylinder block 11 and a cylinder head 12.

The cylinder block 11 includes a plurality of cylinders 13.

Each cylinder 13 includes one cylinder liner 2.

The inner circumferential surface of each cylinder liner 2 (the liner inner circumferential surface 21) forms the inner wall (cylinder inner wall 14) of the corresponding cylinder 13 in the cylinder block 11. Each liner inner circumferential surface 21 defines a cylinder bore 15.

Through the insert casting of a casting material, the outer circumferential surface of each cylinder liner 2 (a liner outer circumferential surface 22) is brought into contact with the cylinder block 11.

As the aluminum alloy as the material of the cylinder block 11, for example, an alloy specified in Japanese Industrial Standard (JIS) ADC10 (related United States standard, ASTM A380.0) or an alloy specified in JIS ADC12 (related United States standard, ASTM A383.0) may be used. In the present embodiment, an aluminum alloy of ADC 12 is used for forming the cylinder block 11.

<Structure of Cylinder Liner>

Figures 2, 3:
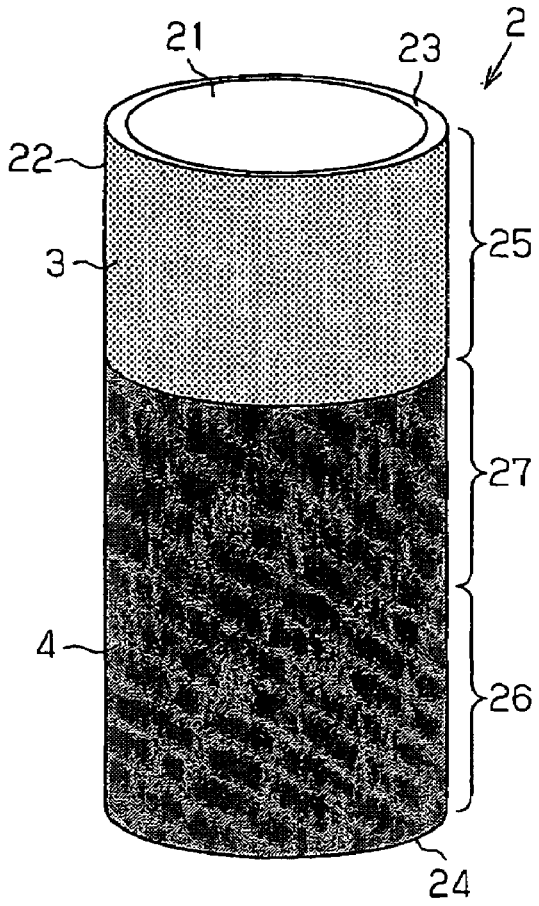
FIG. 2 is a perspective view illustrating the cylinder liner of the first embodiment.
FIG. 3 is a table showing one example of composition ratio of a cast iron, which is a material of the cylinder liner of the first embodiment.

FIG. 2 is a perspective view illustrating the cylinder liner 2 according to the present invention.

The cylinder liner 2 is made of cast iron.

The composition of the cast iron is set, for example, as shown in FIG. 3. Basically, the components listed in table "Basic Component" may be selected as the composition of the cast iron. As necessary, components listed in table "Auxiliary Component" may be added.

In the present embodiment, each portion of the cylinder liner 2 is referred to as shown below.

An upper end of the cylinder liner 2 is referred to as a liner upper end 23.

A lower end of the cylinder liner 2 is referred to as a liner lower end 24.

A section from the liner upper end 23 to a predetermined position along the axial direction is referred to as a liner upper portion 25.

A section from the liner lower end 24 to a predetermined position along the axial direction is referred to as a liner lower portion 26.

A section between the liner upper portion 25 and the liner lower portion 26 is referred to as a liner middle portion 27.

The liner upper end 23 is an end of the cylinder liner 2 that is located at a combustion chamber in the engine 1. The liner lower end 24 is an end of the cylinder liner 2 that is located at a portion opposite to the combustion chamber in the engine 1.

Figure 4:
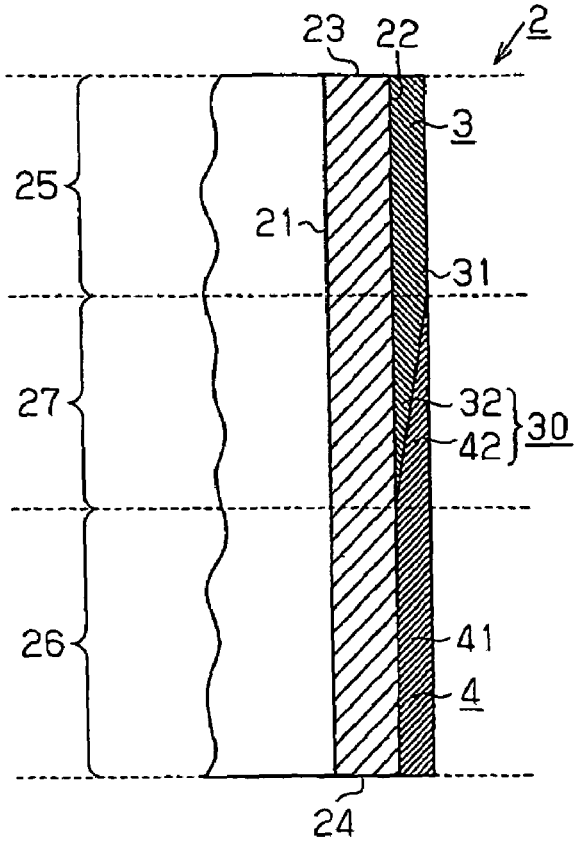
FIG. 4 is a cross-sectional view of the cylinder liner according to the first embodiment taken along the axial direction.

FIG. 4 is a cross-sectional view of the cylinder liner 2 along the axial direction.

In the cylinder liner 2, a high thermal conductive film 3 and a low thermal conductive film 4 are formed on the liner outer circumferential surface 22.

The high thermal conductive film 3 is formed of a material that increases the thermal conductivity between the cylinder block 11 and the cylinder liner 2 compared to the case where such a film is not formed. The material and the forming method of the high thermal conductive film 3 will be discussed below.

The low thermal conductive film 4 is formed of a material that reduces the thermal conductivity between the cylinder block 11 and the cylinder liner 2 compared to the case where such a film is not formed. The material and the forming method of the low thermal conductive film 4 will be discussed below.

The high thermal conductive film 3 and the low thermal conductive film 4 have the configurations shown below.

The high thermal conductive film 3 is formed on the liner outer circumferential surface 22 corresponding to the liner upper portion 25 and the liner middle portion 27. That is, the high thermal conductive film 3 is formed in a section from the liner upper end 23 to the liner lower portion 26.

The high thermal conductive film 3 includes a base film portion 31 located in the liner upper portion 25 and an inclined film portion 32 located in the liner middle portion 27.

The base film portion 31 and the inclined film portion 32 are formed as a continuous film.

The base film portion 31 is formed to have a substantially constant thickness. On the other hand, the inclined film portion 32 is formed such that its thickness is gradually reduced from the liner upper end 23 toward the liner lower end 24.

The low thermal conductive film 4 is formed on the liner outer circumferential surface 22 corresponding to the liner lower portion 26 and the liner middle portion 27. That is, the low thermal conductive film 4 is formed in a section from the liner lower end 24 to the liner upper portion 25.

The low thermal conductive film 4 includes a base film portion 41 located in the liner lower portion 26 and an inclined film portion 42 located in the liner middle portion 27.

The base film portion 41 and the inclined film portion 42 are formed as a continuous film.

The base film portion 41 is formed to have a substantially constant thickness. On the other hand, the inclined film portion 42 is formed such that its thickness is gradually reduced from the liner lower end 24 toward the liner upper end 23.

A laminated film portion 30 is formed on the liner outer circumferential surface 22 of the liner middle portion 27 of the cylinder liner 2. The laminated film portion 30 is formed by laminating the high thermal conductive film 3 and the low thermal conductive film 4. In the laminated film portion 30, the high thermal conductive film 3 is formed on the liner outer circumferential surface 22, and the low thermal conductive film 4 is formed on the high thermal conductive film 3.

Figure 5:
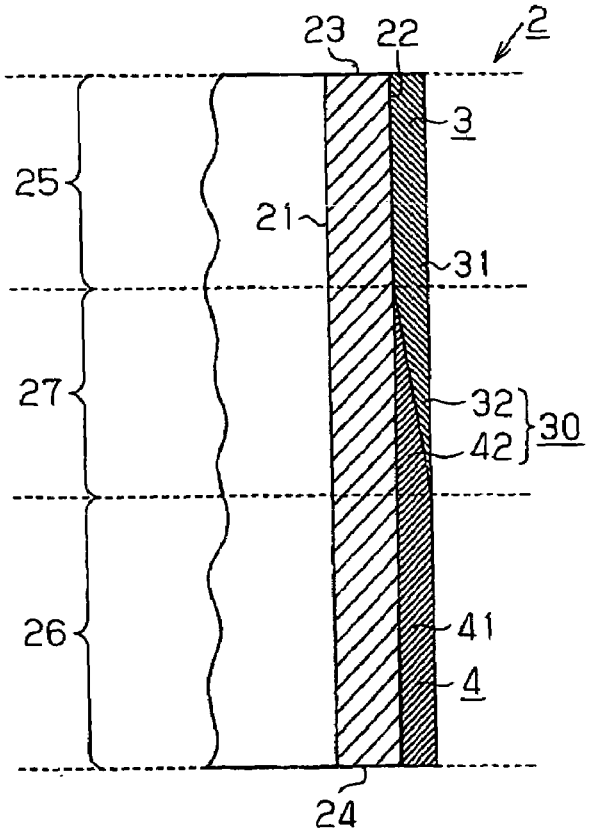
FIG. 5 is a cross-sectional view of the cylinder liner according to the first embodiment taken along the axial direction.

In the cylinder liner 2 of the present embodiment, the laminated film portion 30 is configured as described above. However, the relationship between the high thermal conductive film 3 and the low thermal conductive film 4 in the laminated film portion 30 may be modified as shown in FIG. 5. That is, the laminated film portion 30 may be configured that the low thermal conductive film 4 is formed on the liner outer circumferential surface 22, and the high thermal conductive film 3 is formed on the low thermal conductive film 4.

<Formation of Films>

The formation of the high thermal conductive film 3 and the low thermal conductive film 4 on the cylinder liner 2 (the positions and thicknesses of the films) will hereafter be described.

[1] Position of Films

Figures 6A, 6B:
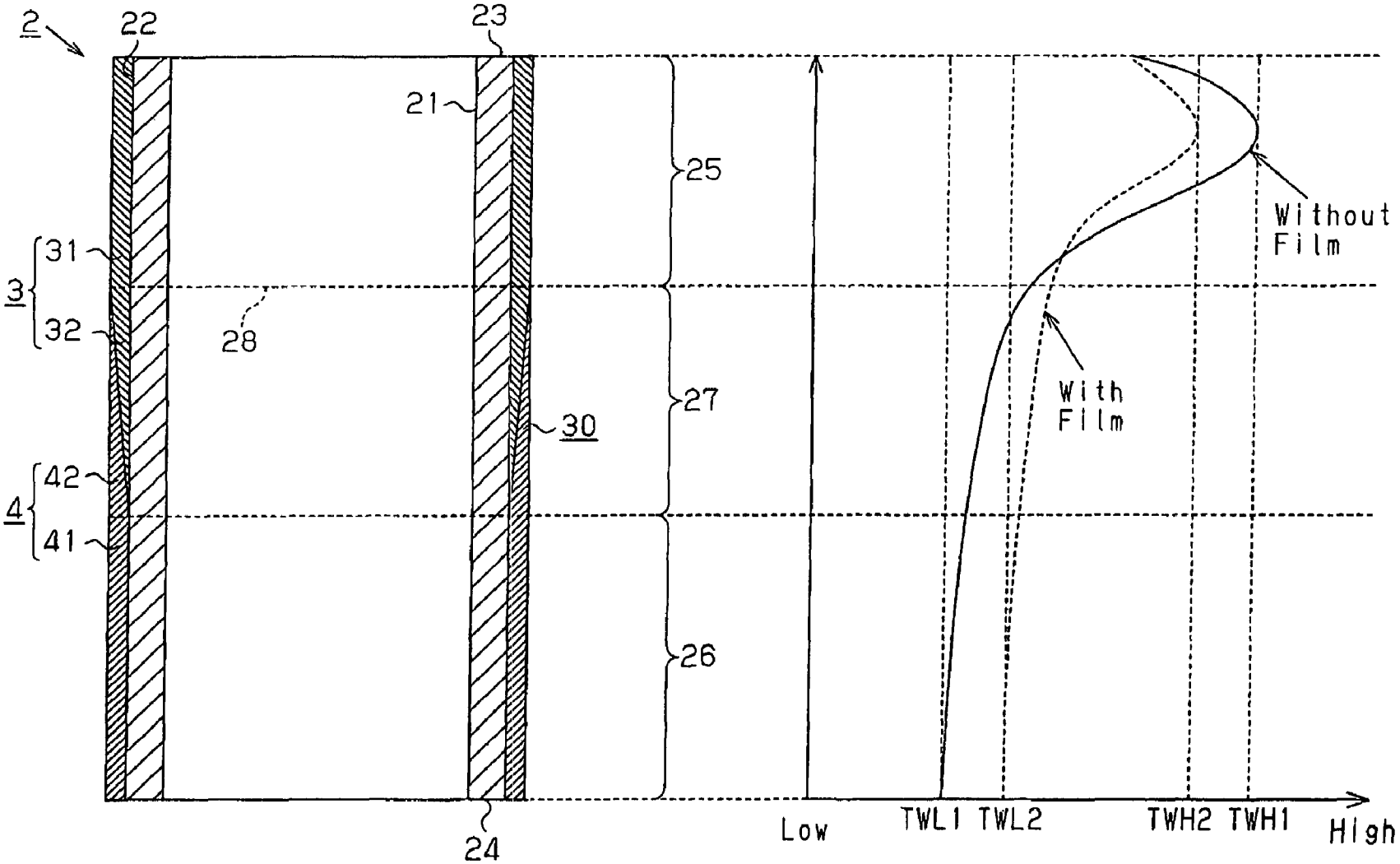
FIG. 6A is a cross-sectional view of the cylinder liner according to the first embodiment taken along the axial direction.
FIG. 6B is a graph showing one example of the relationship between axial positions and the temperature of the cylinder wall in the cylinder liner according to the first embodiment.

Referring to FIGS. 6A and GB, positions of the high thermal conductive film 3 and the low thermal conductive film 4 will be described. FIG. 6A is a cross-sectional view of the cylinder liner 2 along the axial direction. FIG. 6B shows one example of temperature variation along the axial direction in the cylinder (cylinder wall temperature TW) in a normal operating state of the engine. Hereafter, the cylinder liner 2 from which the high thermal conductive film 3 and the low thermal conductive film 4 are removed will be referred to as a reference cylinder liner. An engine having the reference cylinder liners will be referred to as a reference engine.

In this embodiment, the positions of the high thermal conductive film 3 and the low thermal conductive film 4 are determined based on the cylinder wall temperature TW in the reference engine.

The variation of the cylinder wall temperature TW will be described. In FIG. 6B, the solid line represents the cylinder wall temperature TW of the reference engine, and the broken line represents the cylinder wall temperature of the engine 1 of the present embodiment. Hereafter, the highest temperature of the cylinder wall temperature TW is referred to as a maximum cylinder wall temperature TWH, and the lowest temperature of the cylinder wall temperature TW will be referred to as a minimum cylinder wall temperature TWL.

In the reference engine, the cylinder wall temperature TW varies in the following manner.

(A) In an area from the liner lower end 24 to the liner middle portion 27, the cylinder wall temperature TW gradually increases from the liner lower end 24 to the liner middle portion 27 due to a small influence of combustion gas. In the vicinity of the liner lower end 24, the cylinder wall temperature TW is a minimum cylinder wall temperature TWL1.

(B) In an area from the liner middle portion 27 to the liner upper end 23, the cylinder wall temperature TW sharply increases due to a large influence of combustion gas. In the vicinity of the liner upper end 23, the cylinder wall temperature TW is a maximum cylinder wall temperature TWH1.

In combustion engines including the above described reference engine, an increase in the cylinder wall temperature TW causes thermal expansion of the cylinder bores. On the other hand, since the cylinder wall temperature TW varies along the axial direction, the amount of deformation of the cylinder bore varies along the axial direction. Such variation in deformation amount of a cylinder increases the friction of the piston, which degrades the fuel consumption rate.

Thus, in each of the cylinder liner 2 according to the present embodiment, the low thermal conductive film 4 is formed on the liner outer circumferential surface 22 in the liner lower portion 26, while the high thermal conductive film 3 is formed on the liner outer circumferential surface 22 in the liner upper portion 25. This configuration reduces the difference between the maximum cylinder wall temperature TWH and the minimum cylinder wall temperature TWL (cylinder wall temperature difference ΔTW).

In the engine 1 of the present embodiment, the high thermal conductive film 3 increases the thermal conductivity between the cylinder block 11 and the liner upper portion 25. Accordingly, the cylinder wall temperature TW in the liner upper portion 25 is lowered. This causes the maximum cylinder wall temperature TWH to be a maximum cylinder wall temperature TWH2, which is lower than the maximum cylinder wall temperature TWH1.

In the engine 1, the low thermal conductive film 4 lowers the thermal conductivity between the cylinder block 11 and the liner lower portion 26. Accordingly, the cylinder wall temperature TW in the liner lower portion 26 is increased. This causes the minimum cylinder wall temperature TWL to be a minimum cylinder wall temperature TWL2, which is higher than the minimum cylinder wall temperature TWL1.

In this manner, in the engine 1, the difference between the maximum cylinder wall temperature TWH and the minimum cylinder wall temperature TWL (cylinder wall temperature difference ΔTW) is reduced. Accordingly, variation of deformation of each cylinder bore 15 along the axial direction of the cylinder is reduced (deformation amount is equalized). This reduces the friction and thus improves the fuel consumption rate. Also, the laminated film portion 30 suppresses abrupt changes of the cylinder wall temperature TW in the liner middle portion 27. This further reliably equalizes the amount of deformation of the cylinder bore 15.

The boundary between the liner upper portion 25 and the liner middle portion 27 (wall temperature boundary 28) can be obtained based on the cylinder wall temperature TW of the reference engine. On the other hand, it has been found out that in many cases the length of the liner upper portion 25 (the length from the liner upper end 23 to the wall temperature boundary 28) is one third to one quarter of the entire length of the cylinder liner 2 (the length from the liner upper end 23 to the liner lower end 24). Therefore, when determining the position of the high thermal conductive film 3, one third to one quarter range from the liner upper end 23 in the entire liner length may be treated as the liner upper portion 25 without precisely determining the wall temperature boundary 28.

[2] Thickness of Films

The setting of the thickness of the high thermal conductive film 3 and the low thermal conductive film 4 will now be described.

In the cylinder liner 2, the thickness of the base film portion 31 of the high thermal conductive film 3 and the thickness of the base film portion 41 of the low thermal conductive film 4 are substantially equal to each other. Also, the thickness of the laminated film portion 30 is substantially equal to the thickness of the base film portion 31 of the high thermal conductive film 3 and the thickness of the base film portion 41 of the low thermal conductive film 4. That is, the thickness of the high thermal conductive film 3 and the thickness of the low thermal conductive film 4 are determined such that a film having a substantially constant thickness is formed from the liner upper end 23 to the liner lower end 24.

<Formation of High Thermal Conductive Film>

As the material for the high thermal conductive film 3, a material that meets at least one of the following conditions (A) and (B) may be used.

(A) A material the melting point of which is lower than or equal to the temperature of the molten metal of the casting material (reference molten metal temperature TC), or a material containing such a material. More specifically, the reference molten metal temperature TC can be described as below. That is, the reference molten metal temperature TC refers to the temperature of the molten metal of the casting material of the cylinder block 11 when the casting material is supplied to a mold for performing the insert casting of the cylinder liners 2.

(B) A material that can be metallurgically bonded to the casting material of the cylinder block 11, or a material containing such a material.

As the method for forming the high thermal conductive film 3, any of the following methods may be employed.

[1] Spraying

[2] Shot coating

[3] Plating

Hereinafter, chief examples of the high thermal conductive film 3 are shown.

[1] First Configuration of High Thermal Conductive Film

In the cylinder liner 2, a layer formed by spraying may be adopted as the high thermal conductive film 3. As the material of the sprayed layer, aluminum, an aluminum alloy, copper, or a copper alloy may be mainly used.

In a case where the high thermal conductive film 3 is formed of a sprayed layer of an aluminum alloy (Al—Si alloy), the cylinder block 11 and the cylinder liner 2 are bonded to each in the following manner.

As for the bonding state of the liner upper portion 25 and the high thermal conductive film 3, since the high thermal conductive film 3 is formed by spraying, the liner upper portion 25 and the high thermal conductive film 3 are mechanically bonded to each other with sufficient adhesion and bond strength. The adhesion of the liner upper portion 25 and the high thermal conductive film 3 is higher than the adhesion of the cylinder block and the reference cylinder liner in the reference engine.

As for the bonding state of the cylinder block 11 and the high thermal conductive film 3, the high thermal conductive film 3 is formed of an Al—Si alloy that has a melting point lower than the reference molten metal temperature TC and a high wettability with the casting material of the cylinder block 11. Thus, the cylinder block 11 and the high thermal conductive film 3 are mechanically bonded to each other with sufficient adhesion and bond strength. The adhesion of the cylinder block 11 and the high thermal conductive film 3 is higher than the adhesion of the cylinder block and the reference cylinder liner in the reference engine.

In the engine 1, since the cylinder block 11 and the liner upper portion 25 are bonded to each other in this state, the following advantages are obtained.

[A] Since the high thermal conductive film 3 ensures the adhesion between the cylinder block 11 and the liner upper portion 25, the thermal conductivity between the cylinder block 11 and the liner liner upper portion 25 is increased.

[B] Since the high thermal conductive film 3 ensures the bond strength between the cylinder block 11 and the liner liner upper portion 25, exfoliation of the cylinder block 11 and the liner upper portion 25 is suppressed. Therefore, even if the cylinder bore 15 is expanded, the adhesion of the cylinder block 11 and the liner upper portion 25 is maintained. This suppresses the reduction in the thermal conductivity.

Further, when the above described configuration is applied to the high thermal conductive film 3, the following advantages are obtained.

[C] Since the high thermal conductive film 3 is formed by spraying of an Al—Si alloy, the difference between the degree of expansion of the cylinder block 11 and the degree of expansion of the high thermal conductive film 3 is reduced. Thus, when the cylinder bore 15 expands, the adhesion between the cylinder block 11 and the cylinder liner 2 is ensured.

[D] Since an Al—Si alloy that has a high wettability with the casting material of the cylinder block 11 is used, the adhesion and the bond strength between the cylinder block 11 and the high thermal conductive film 3 are further increased.

In the engine 1, as the adhesion between the cylinder block 11 and the high thermal conductive film 3 and the adhesion between the liner upper portion 25 and the high thermal conductive film 3 are lowered, the amount of gap between these components is increased. Accordingly, the thermal conductivity between the cylinder block 11 and the liner upper portion 25 is reduced. As the bond strength between the cylinder block 11 and the high thermal conductive film 3 and the bond strength between the liner upper portion 25 and the high thermal conductive film 3 are reduced, it is more likely that exfoliation occurs between these components. Therefore, when the cylinder bore 15 is expanded, the adhesion between the cylinder block 11 and the liner upper portion 25 is reduced.

It is believed that, in the case where the melting point of the high thermal conductive film 3 is less than or equal to the reference molten metal temperature TC, the high thermal conductive film 3 is melt and metallurgically bonded to the casting material when producing the cylinder block 11. However, according to the results of tests performed by the present inventors, it was confirmed that the cylinder block 11 as described above was mechanically bonded to the high thermal conductive film 3. Further, metallurgically bonded portions were found. However, cylinder block 11 and the high thermal conductive film 3 were mainly bonded in a mechanical manner.

Through the tests, the inventors also found out the following. That is, even if the casting material and the high thermal conductive film 3 were not metallurgically bonded (or only partly bonded in a metallurgical manner), the adhesion and the bond strength of the cylinder block 11 and the liner upper portion 25 were increased as long as the high thermal conductive film 3 had a melting point less than or equal to the reference molten metal temperature TC. Although the mechanism has not been accurately elucidated, it is believed that the rate of solidification of the casting material is reduced due to the fact that the heat of the casting material is not smoothly removed by the high thermal conductive film 3.

[2] Second Configuration of High Thermal Conductive Film

In the cylinder liner 2, a layer formed by shot coating may be adopted as the high thermal conductive film 3. As the material of the shot coating layer, aluminum, an aluminum alloy, copper, and zinc may be mainly used.

In a case where the high thermal conductive film 3 is formed of a shot coating layer of aluminum, the cylinder block 11 and the cylinder liner 2 are bonded to each in the following manner.

As for the bonding state of the liner upper portion 25 and the high thermal conductive film 3, since the high thermal conductive film 3 is formed by shot coating, the liner upper portion 25 and the high thermal conductive film 3 are mechanically and metallurgically bonded to each other with sufficient adhesion and bond strength. That is, the liner upper portion 25 and the high thermal conductive film 3 are bonded to each other in a state where mechanically bonded portions and metallurgically bonded portions are mingled. The adhesion of the liner upper portion 25 and the high thermal conductive film 3 is higher than the adhesion of the cylinder block and the reference cylinder liner in the reference engine.

As for the bonding state of the cylinder block 11 and the high thermal conductive film 3, the high thermal conductive film 3 is formed of aluminum that has a melting point lower than the reference molten metal temperature TC and a high wettability with the casting material of the cylinder block 11. Thus, the cylinder block 11 and the high thermal conductive film 3 are mechanically bonded to each other with sufficient adhesion and bond strength. The adhesion of the cylinder block 11 and the high thermal conductive film 3 is higher than the adhesion of the cylinder block and the reference cylinder liner in the reference engine.

In the engine 1, since the cylinder block 11 and the liner upper portion 25 are bonded to each other in this state, the advantages [A] and [B] in "[1] First Configuration of High Thermal Conductive Film are obtained. As for the mechanical joint between the cylinder block 11 and the high thermal conductive film 3, the same explanation as that of "[1] First Configuration of High Thermal Conductive Film" can be applied.

Further, when the above described configuration is applied to the high thermal conductive film 3, the following advantages are obtained.

[C] In the shot coating, the high thermal conductive film 3 is formed without melting the coating material. Therefore, the high thermal conductive film 3 contains no oxides. Therefore, the thermal conductivity of the high thermal conductive film 3 is prevented from degraded by oxidation.

[3] Third Configuration of High Thermal Conductive Film

In the cylinder liner 2, a layer formed by plating may be adopted as the high thermal conductive film 3. As the material of the plated layer, aluminum, an aluminum alloy, copper, or a copper alloy may be mainly used.

In a case where the high thermal conductive film 3 is formed of a plated layer of a copper alloy, the cylinder block 11 and the cylinder liner 2 are bonded to each other in the following manner. The laminated film portion 30 is configured as shown in FIG. 5.

As for the bonding state of the liner upper portion 25 and the high thermal conductive film 3, since the high thermal conductive film 3 is formed by plating, the liner upper portion 25 and the high thermal conductive film 3 are mechanically bonded to each other with sufficient adhesion and bond strength. The adhesion of the liner upper portion 25 and the high thermal conductive film 3 is higher than the adhesion of the cylinder block and the reference cylinder liner in the reference engine.

As for the bonding state of the cylinder block 11 and the high thermal conductive film 3, the high thermal conductive film 3 is formed of a copper alloy that has a melting point higher than the reference molten metal temperature TC. However, the cylinder block 11 and the high thermal conductive film 3 are metallurgically bonded to each other with sufficient adhesion and bond strength. The adhesion of the cylinder block 11 and the high thermal conductive film 3 is higher than the adhesion of the cylinder block and the reference cylinder liner in the reference engine.

In the engine 1, since the cylinder block 11 and the liner upper portion 25 are bonded to each other in this state, the advantages [A] and [B] in "[1] First Configuration of High Thermal Conductive Film are obtained.

Further, when the above described configuration is applied to the high thermal conductive film 3, the following advantages are obtained.

[C] Since the cylinder block 11 and the high thermal conductive film 3 are metallurgically bonded to each other, the adhesion and the bond strength between the cylinder block 11 and the liner upper portion 25 are further increased.

[D] Since the high thermal conductive film 3 is formed of a copper alloy having a greater thermal conductivity than that of the cylinder block 11, the thermal conductivity between the cylinder block 11 and the liner upper portion 25 is further increased.

To metallurgically bonding the cylinder block 11 and the high thermal conductive film 3 to each other, it is believed that the high thermal conductive film 3 basically needs to be formed with a metal having a melting point equal to or less than the reference molten metal temperature TC. However, according to the results of the tests performed by the present inventors, even if the high thermal conductive film 3 is formed of a metal having a melting point higher than the reference molten metal temperature TC, the cylinder block 11 and the high thermal conductive film 3 are metallurgically bonded to each other in some cases.

<Formation of Low Thermal Conductive Film>

As the material for the low thermal conductive film 4, a material that meets at least one of the following conditions (A) and (B) may be used.

(A) A material that reduces the adhesion of the cylinder block 11 with the casting material, or a material containing such a material.

(B) A material the thermal conductivity of which is lower than that of at least one of the cylinder block 11 and the cylinder liner 2, or a material containing such a material.

As the method for forming the low thermal conductive film 4, any of the following methods may be employed.

[1] Spraying

[2] Painting

[3] Resin coating

[4] Chemical conversion treatment

Hereinafter, chief examples of the low thermal conductive film 4 are shown.

[1] First Configuration of Low Thermal Conductive Film

In the cylinder liner 2, a layer formed by spraying may be adopted as the low thermal conductive film 4. As the material of the sprayed layer, an ceramic material such as alumina and zirconia may be mainly used. Alternatively, the low thermal conductive film 4 may be formed of a sprayed layer of an iron based material that includes oxides and a number of pores.

In a case where the low thermal conductive film 4 is formed of a sprayed layer of alumina, the cylinder block 11 and the cylinder liner 2 are bonded to each in the following manner.

As for the bonding state of the cylinder block 11 and the low thermal conductive film 4, since the low thermal conductive film 4 is formed of alumina, which has a lower thermal conductivity than that of the cylinder block 11, the cylinder block 11 and the low thermal conductive film 4 are mechanically bonded to each other in a state of a low thermal conductivity.

In the engine 1, since the cylinder block 11 and the liner lower portion 26 are bonded to each other in this state, the following advantages are obtained. That is, since the low thermal conductive film 4 reduces the thermal conductivity between the cylinder block 11 and the liner lower portion 26, the cylinder wall temperature TW in the liner lower portion 26 is increased.

[2] Second Configuration of Low Thermal Conductive Film

In the cylinder liner 2, a layer of a mold release agent for die casting formed by painting may be adopted as the low thermal conductive film 4. As the mold release agent, the following agents may be used.

A mold release agent obtained by compounding vermiculite, Hitazol, and water glass.

A mold release agent obtained by compounding a liquid material, a major component of which is silicon, and water glass.

In a case where the low thermal conductive film 4 is formed of a layer of a mold release agent, the cylinder block 11 and the cylinder liner 2 are bonded to each in the following manner.

As for the bonding state of the cylinder block 11 and the low thermal conductive film 4, since the low thermal conductive film 4 is formed of a mold release agent, which has a low adhesion with the cylinder block 11, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased. Also, the mold release agent for die casting used during the production of the cylinder block 11 or a material for such mold release agent can be used. Thus, the number of producing steps and costs are reduced.

[3] Third Configuration of Low Thermal Conductive Film

In the cylinder liner 2, a layer of a mold wash for centrifugal casting formed by painting may be adopted as the low thermal conductive film 4. As the mold wash, the following agents may be used.

A mold wash containing diatomaceous earth as a major component.

A mold wash containing graphite as a major component.

In a case where the low thermal conductive film 4 is formed of a layer of a mold wash, the cylinder block 11 and the cylinder liner 2 are bonded to each in the following manner.

As for the bonding state of the cylinder block 11 and the low thermal conductive film 4, since the low thermal conductive film 4 is formed of a mold wash, which has a low adhesion with the cylinder block 11, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased. Also, the mold wash for centrifugal casting used during the production of the cylinder liner 2 or a material for such a mold wash can be used. Thus, the number of producing steps and costs are reduced.

[4] Fourth Configuration of Low Thermal Conductive Film

In the cylinder liner 2, a layer of a metallic paint formed by painting may be adopted as the low thermal conductive film 4.

In a case where the low thermal conductive film 4 is formed of a layer of a metallic paint, the cylinder block 11 and the cylinder liner 2 are bonded to each in the following manner.

As for the bonding state of the cylinder block 11 and the low thermal conductive film 4, since the low thermal conductive film 4 is formed of a metallic paint, which has a low adhesion with the cylinder block 11, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased.

[5] Fifth Configuration of Low Thermal Conductive Film

In the cylinder liner 2, a layer of a low adhesion agent formed by painting may be adopted as the low thermal conductive film 4. As the low adhesion agent, the following agents may be used.

A low adhesion agents obtained by compounding graphite, water glass, and water.

A low adhesion agent obtained by compounding boron nitride and water glass.

In a case where the low thermal conductive film 4 is formed of a layer of a low adhesion agent, the cylinder block 11 and the cylinder liner 2 are bonded to each in the following manner.

As for the bonding state of the cylinder block 11 and the low thermal conductive film 4, since the low thermal conductive film 4 is formed of a low adhesion agent, which has a low adhesion with the cylinder block 11, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased.

[6] Sixth Configuration of Low Thermal Conductive Film

In the cylinder liner 2, a layer of a high-temperature resin formed by resin coating may be adopted as the low thermal conductive film 4.

In a case where the low thermal conductive film 4 is formed of a layer of a high-temperature resin, the cylinder block 11 and the cylinder liner 2 are bonded to each in the following manner.

As for the bonding state of the cylinder block 11 and the low thermal conductive film 4, since the low thermal conductive film 4 is formed of a high-temperature resin, which has a low adhesion with the cylinder block 11, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased.

[7] Seventh Configuration of Low Thermal Conductive Film

In the cylinder liner 2, a layer formed by chemical conversion treatment spraying may be adopted as the low thermal conductive film 4. As the chemical conversion treatment layer, the following layers maybe formed.

A chemical conversion treatment layer of phosphate.

A chemical conversion treatment layer of ferrosoferric oxide.

In a case where the low thermal conductive film 4 is formed of a chemical conversion treatment layer, the cylinder block 11 and the cylinder liner 2 are bonded to each in the following manner. The laminated film portion 30 is configured as shown in FIG. 5.

As for the bonding state of the cylinder block 11 and the low thermal conductive film 4, since the low thermal conductive film 4 is formed of a chemical conversion treatment layer, the cylinder block 11 and the low thermal conductive film 4 are bonded to each other with gaps.

In the engine 1, since the cylinder block 11 and the liner lower portion 26 are bonded to each other in this state, the following advantages are obtained. That is, since the gaps reduce the thermal conductivity between the cylinder block 11 and the liner lower portion 26, the cylinder wall temperature TW in the liner lower portion 26 is increased. The low thermal conductive film 4 is formed to have a sufficient thickness at the constriction 63 of each of projections 6, which will be described below. Therefore, the gaps are easily formed about the constrictions 63. Accordingly, the thermal conductivity is effectively prevented from being lowered.

<Structure of Laminated Film Portion>

The configuration of the high thermal conductive film 3 and the low thermal conductive film 4 can be difficult to freely selected depending on the method of forming (mainly, plating and chemical conversion treatment). Therefore, when producing the cylinder liner 2 by combining the high thermal conductive film 3 and the low thermal conductive film 4 as necessary, a configuration of the laminated film portion 30 that is suitable for each method needs to be adopted. That is, appropriate setting of the order of formation of the films in accordance with the forming method eliminates the disadvantage of impractical combinations of films.

The configuration of the laminated film portion 30 is classified into a first lamination configuration and a second lamination configuration.

The first lamination configuration refers to a configuration in which the high thermal conductive film 3 is located on the liner outer circumferential surface 22, and the low thermal conductive film 4 is located on the high thermal conductive film 3. That is, it corresponds to the laminated film portion 30 shown in FIG. 4.

The second lamination configuration refers to a configuration in which the low thermal conductive film 4 is located on the liner outer circumferential surface 22, and the high thermal conductive film 3 is located on the low thermal conductive film 4. That is, it corresponds to the laminated film portion 30 shown in FIG. 5.

Hereafter, the configuration (the order of formation of the films) of the laminated film portion 30 suitable for the method for forming the high thermal conductive film 3 and the low thermal conductive film 4 will be described.

(A) In the case where spraying or shot coating is adopted as a method for forming the high thermal conductive film 3, both of the first lamination configuration and the second lamination configuration can be selected as the configuration of the laminated film portion 30. That is, the order of formation of the films can be arbitrarily selected.

(B) In the case where plating is adopted as a method for forming the high thermal conductive film 3, only the second lamination configuration can be selected as the configuration of the laminated film portion 30. That is, by setting the order of formation of the films as shown below, the laminated film portion 30 is formed to have an appropriate configuration.

[1] Form the low thermal conductive film 4 by spraying, paining, or resin coating.

[2] Form the high thermal conductive film 3 by plating after the formation of the low thermal conductive film 4.

(C) In the case where spraying is adopted as a method for forming the low thermal conductive film 4, both of the first lamination configuration and the second lamination configuration can be selected as the configuration of the laminated film portion 30. That is, the order of formation of the films can be arbitrarily selected.

(D) In the case where painting or resin coating is adopted as a method for forming the low thermal conductive film 4, both of the first lamination configuration and the second lamination configuration can be selected as the configuration of the laminated film portion 30, though not quite satisfactorily. However, depending on the materials, the formability of the films are significantly degraded. Thus, it is preferable to select the first lamination configuration for the laminated film portion 30. That is, by setting the order of formation of the films as shown below, the formability of the laminated film portion 30 is improved.

[1] Form the high thermal conductive film 3 by spraying or shot coating.

[2] Form the low thermal conductive film 4 by painting or resin coating after the formation of the high thermal conductive film 3.

(E) In the case where chemical conversion treatment is adopted as a method for forming the low thermal conductive film 4, only the first lamination configuration can be selected as the configuration of the laminated film portion 30. That is, by setting the order of formation of the films as shown below, the laminated film portion 30 is formed to have an appropriate configuration.

[1] Form the high thermal conductive film 3 by spraying or shot coating.

[2] Form the low thermal conductive film 4 by chemical conversion treatment after the formation of the high thermal conductive film 3.

Advantages of Embodiment

The cylinder liner and the method for manufacturing the same according to the present embodiment provide the following advantages.

(1) In the cylinder liner 2 of the present embodiment, the low thermal conductive film 4 is formed on the liner outer circumferential surface 22 of the liner lower portion 26, while the high thermal conductive film 3 is formed on the liner outer circumferential surface 22 of the liner upper portion 25. Accordingly, the difference between the maximum cylinder wall temperature TWH and the minimum cylinder wall temperature TWL in the engine 1 is reduced. Thus, variation of deformation of each cylinder bore 15 along the axial direction of the cylinder 13 is reduced. Accordingly, deformation amount of deformation of each cylinder bore 15 is equalized. This reduces the friction and thus improves the fuel consumption rate.

(2) In the cylinder liner 2 of the present embodiment, the laminated film portion 30 is formed on the liner outer circumferential surface 22 of the liner middle portion 27. This prevents abrupt changes in the cylinder wall temperature TW in the axial direction of the cylinder 13. Thus, deformation of the cylinder bore 15 is stabilized, and the fuel consumption rate is improved, accordingly.

(3) In the cylinder liner 2 of the present embodiment, the thickness of the inclined film portion 32 of the high thermal conductive film 3 is gradually reduced from the liner upper end 23 toward the liner lower end 24. Accordingly, the thermal conductivity of the high thermal conductive film 3 is reduced from the liner upper portion 25 toward the liner lower portion 26. This reliably suppresses abrupt changes in the cylinder wall temperature TW.

(4) In the cylinder liner 2 of the present embodiment, the thickness of the inclined film portion 42 of the low thermal conductive film 4 is gradually reduced from the liner lower end 24 toward the liner upper end 23. Accordingly, the thermal conductivity of the low thermal conductive film 4 is reduced from the liner lower portion 26 toward the liner upper portion 25. This reliably suppresses abrupt changes in the cylinder wall temperature TW.

(5) In the reference engine, since the consumption of the engine oil is promoted when the cylinder wall temperature TW of the liner upper portion 25 is excessively increased, the tension of the piston rings are required to be relatively great. That is, the fuel consumption rate is inevitably degraded by the increase in the tension of the piston rings.

In the cylinder liner 2 according to the present embodiment, sufficient adhesion between the cylinder block 11 and the liner upper portions 25 is established, that is, little gap is created about each liner upper portion 25. This ensures a high thermal conductivity between the cylinder block 11 and the liner upper portions 25. Accordingly, since the cylinder wall temperature TW in the liner upper portion 25 is lowered, the consumption of the engine oil is reduced. Since the consumption of the engine oil is suppressed in this manner, piston rings of a less tension compared to those in the reference engine can be used. This improves the fuel consumption rate.

(6) In the reference engine 1, the cylinder wall temperature TW in the liner lower portion 26 is relatively low. Thus, the viscosity of the engine oil at the liner inner circumferential surface 21 of the liner lower portion 26 is excessively high. That is, since the friction of the piston at the liner lower portion 26 of the cylinder 13 is great, deterioration of the fuel consumption rate due to such an increase in the friction is inevitable. Such deterioration of the fuel consumption rate due to the cylinder wall temperature TW is particularly noticeable in engines in which the thermal conductivity of the cylinder block is relatively great, such as an engine made of an aluminum alloy.

In the cylinder liner 2 of the present embodiment, since the thermal conductivity between the cylinder block 11 and the liner lower portion 26 is low, the cylinder wall temperature TW in the liner lower portion 26 is increased. This reduces the viscosity of the engine oil on the liner inner circumferential surface 21 of the liner lower portion 26, and thus reduces the friction. Accordingly, the fuel consumption rate is improved.

Modifications of Embodiment

The above illustrated first embodiment may be modified as shown below.

In the first embodiment, the laminated film portion 30 is formed in the liner middle portion 27. However, the position of the laminated film portion may be changed as necessary according to the relationship with the demanded cylinder wall temperature TW. For example, the position of the laminated film portion 30 may be selected from the following configurations [A] to [D].

[A] Form the laminated film portion 30 on the liner upper portion 25.

[B] Form the laminated film portion 30 to be spread over the liner upper portion 25 and the liner middle portion 27.

[C] Form the laminated film portion 30 to be spread over the liner middle portion 27 and the liner lower portion 26.

[B] Form the laminated film portion 30 to be spread over the liner upper portion 25 and the liner lower portion 26.

[E] Form the laminated film portion 30 on the liner lower portion 26.

The method for forming the high thermal conductive film 3 is not limited to the methods shown in the first embodiment (spraying, shot coating, and plating). Any other method may be applied as necessary.

The method for forming the low thermal conductive film 4 is not limited to the methods shown in the first embodiment (spraying, coating, resin coating, and chemical conversion treatment). Any other method may be applied as necessary.

In the first embodiment, the film thickness TP of the high thermal conductive film 3 may be gradually increased from the liner upper end 23 to the liner middle portion 27. In this case, the thermal conductivity between the cylinder block 11 and the liner upper portion 25 decreases from the liner upper end 23 to the liner middle portion 27. Thus, the difference of the cylinder wall temperature TW in the liner upper portion 25 along the axial direction is reduced.

In the first embodiment, the film thickness TP of the low thermal conductive film 4 may be gradually decreased from the liner lower end 24 to the liner middle portion 27. In this case, the thermal conductivity between the cylinder block 11 and the liner lower portion 26 increases from the liner lower end 24 to the liner middle portion 27. Thus, the difference of the cylinder wall temperature TW in the liner lower portion 26 along the axial direction is reduced.

The configuration of the formation of the high thermal conductive film 3 according to the first embodiment may be modified as shown below. That is, the high thermal conductive film 3 may be formed of any material as long as at least one of the following conditions (A) and (B) is met. (A) The thermal conductivity of the high thermal conductive film 3 is greater than that of the cylinder liner 2.

(B) The thermal conductivity of the high thermal conductive film 3 is greater than that of the cylinder block 11.

The configuration of the formation of the low thermal conductive film 4 according to the above embodiments may be modified as shown below. That is, the low thermal conductive film 4 may be formed of any material as long as at least one of the following conditions (A) and (B) is met.

(A) The thermal conductivity of the low thermal conductive film 4 is smaller than that of the cylinder liner 2.

(B) The thermal conductivity of the low thermal conductive film 4 is smaller than that of the cylinder block 11.

In the first embodiment, the low thermal conductive film 4 is formed along the entire circumference of the cylinder liner 2. However, the position of the low thermal conductive film 4 may be changed as shown below. That is, with respect to the direction along which the cylinders 13 are arranged, the film 4 may be omitted from sections of the liner outer circumferential surfaces 22 that face the adjacent cylinder bores 15. In other words, the low thermal conductive films 4 may be formed in sections except for sections of the liner outer circumferential surfaces 22 that face the liner outer circumferential surfaces 22 of the adjacent cylinder liners 2 with respect to the arrangement direction of the cylinders 13. This configuration provides the following advantages (i) and (ii).

(i) Heat from each adjacent pair of the cylinders 13 is likely to be confined in a section between the corresponding cylinder bores 15. Thus, the cylinder wall temperature TW in this section is likely to be higher than that in the sections other than the sections between the cylinder bores 15. Therefore, the above described modification of the formation of the low thermal conductive film 4 prevents the cylinder wall temperature TW in a section facing the adjacent the cylinder bores 15 with respect to the circumferential direction of the cylinders 13 is prevented from excessively increased.

(ii) In each cylinder 13, since the cylinder wall temperature TW varies along the circumferential direction, the amount of deformation of the cylinder bore 15 varies along the circumferential direction. Such variation in deformation amount of the cylinder bore 15 increases the friction of the piston, which degrades the fuel consumption rate.

When the above configuration of the formation of the films 3 and 4 is adopted, the thermal conductivity is lowered in sections other than the sections facing the adjacent cylinder bores 15 with respect to the circumferential direction of the cylinder 13. On the other hand, the thermal conductivity of the sections facing the adjacent cylinder bores 15 is the same as that of conventional engines. This reduces the difference between the cylinder wall temperature TW in the sections other than the sections facing the adjacent cylinder bores 15 and the cylinder wall temperature TW in the sections facing the adjacent the cylinder bores 15. Accordingly, variation of deformation of each cylinder bore 15 along the circumferential direction is reduced (deformation amount is equalized). This reduces the friction of the piston and thus improves the fuel consumption rate.

Second Embodiment

A second embodiment of the present invention will now be described with reference to FIGS. 7A to 8C.

The second embodiment is configured by changing the formation of the films in the cylinder liner according to the first embodiment in the following manner. The cylinder liner according to the second embodiment is the same as that of the first embodiment except for the configuration described below.

<Formation of Films>

Figures 7A, 7B:
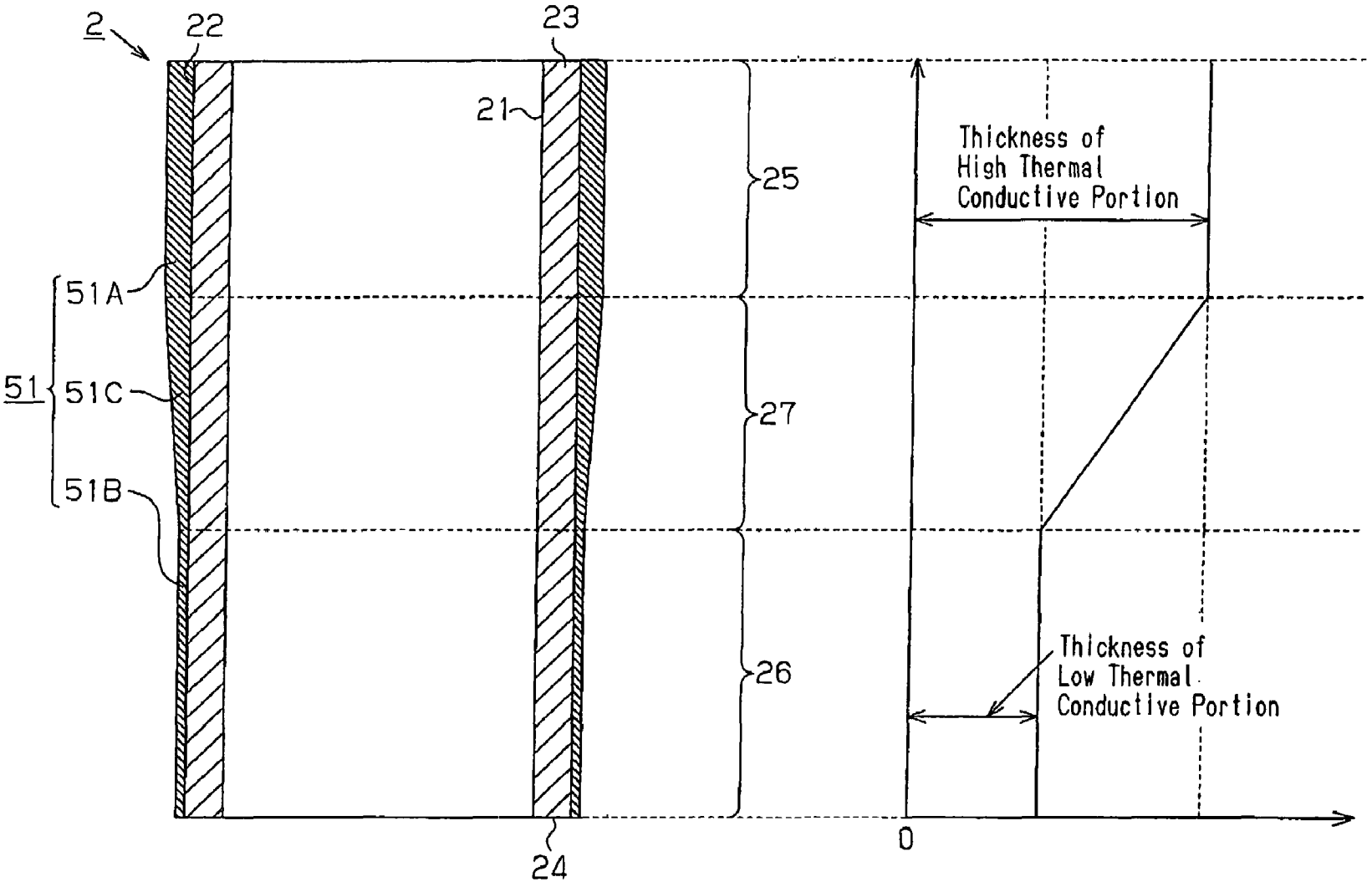
FIG. 7A is a cross-sectional view taken along an axial direction, illustrating a cylinder liner according to a second embodiment of the present embodiment.
FIG. 7B is a graph showing the relationship between the axial position and the film thickness.

Referring to FIGS. 7A and 7B, the formation of the films will be described. FIG. 7A is a cross-sectional view of the cylinder liner 2 along the axial direction. FIG. 7B shows the relationship between the axial position and the film thickness.

In the cylinder liner 2, a film 51 is formed on the liner outer circumferential surface 22 from the liner upper end 23 to the liner lower end 24.

The film 51 is formed of an Al—Si alloy sprayed layer. The film 51 includes a high thermal conductive portion 51A located in the liner upper portion 25, a low thermal conductive portion 51B located in the liner lower portion 26, and an inclined film portion 51C located in the liner middle portion 27. The high thermal conductive portion 51A, the low thermal conductive portion 51B, and the inclined film portion 51C are formed as a continuous film.

The thickness of each portion of the film 51 is set as follows.

The thickness of the high thermal conductive portion 51A is substantially constant.

The thickness of the low thermal conductive portion 51B is substantially constant.

The thickness of the low thermal conductive portion 51B is less than the thickness of the high thermal conductive portion 51A.

The thickness of the inclined film portion 51C is gradually reduced from the liner upper end 23 toward the liner lower end 24.

<Method for Producing Films>

Figure 8C:
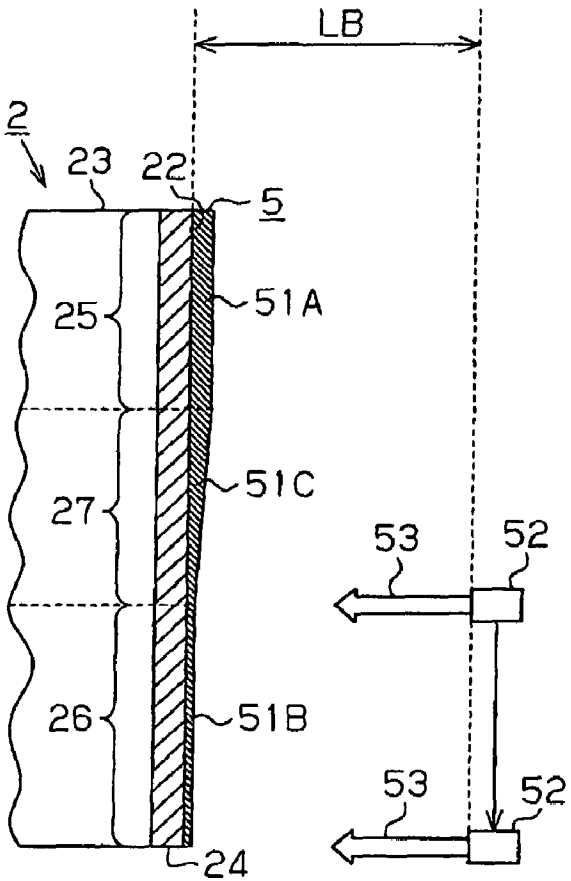
FIGS. 8A to 8C are diagrams showing one example of a procedure for forming a film on the cylinder liner of the second embodiment.
Figure 8B:
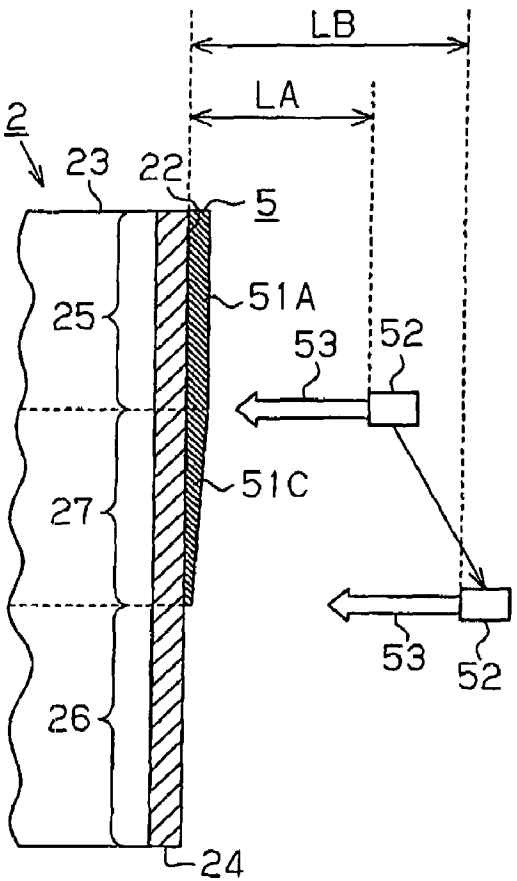

The method for forming the film 51 will be described with reference to FIGS. 8A to 8C.

In this embodiment, the distance (spraying distance L) between a nozzle of a spraying device 52 and the liner outer circumferential surface 22 is adjusted when forming the film 51 by spraying. That is, a film is formed on the liner outer circumferential surface 22 of the liner lower portion 26 by spraying at a low-rate spraying distance LB, while a film is formed on the liner outer circumferential surface 22 of the liner upper portion 25 by spraying at a reference spraying distance LA.

The reference spraying distance LA and the low-rate spraying distance LB are set in the following manner.

(A) The reference spraying distance LA is set to the spraying distance L when the deposit efficiency of a spraying material 53 is highest.

(B) The low-rate spraying distance LB is set to the spraying distance L when the deposit efficiency of the spraying material 53 is lower than that in the case when the spraying distance L is set to the reference spraying distance LA. That is, the low-rate spraying distance LB is greater than the reference spraying distance LA.

When performing spraying, some of the material 53 does not collect on the outer circumferential surface 22 but is oxidized about the surface 22. If the deposit efficiency of the spraying material 53 is low, such an oxidized portion of the material 53 is increased. Some of the oxidized portion of the spraying material 53 commingles with a sprayed layer that is being formed on the liner outer circumferential surface 22. Thus, the finishes sprayed layer contains a great amount of oxides in it.

Therefore, in the case where the spraying distance L is set to the low-rate spraying distance LB, a sprayed layer containing a great amount of oxides in it is formed on the liner outer circumferential surface 22. That is, a sprayed layer having a low thermal conductivity is formed. On the other hand, in the case where the spraying distance L is set to the reference spraying distance LA, a sprayed layer that has a higher thermal conductivity than that in the case where the spraying distance L is set to the low-rate spraying distance LB is formed on the liner outer circumferential surface 22.

In the present embodiment, the spraying distance L is set to the low-rate spraying distance LB when forming a sprayed layer on the liner lower portion 26, while the spraying distance L is set to the reference spraying distance LA when forming a sprayed layer on the liner upper portion 25. Therefore, a difference in the thermal conductivity is created between the high thermal conductive portion 51A of the liner upper portion 25 and the low thermal conductive portion 51B of the liner lower portion 26, and the thermal conductivity of the high thermal conductive portion 51A is higher than that of the low thermal conductive portion 51B. This increases the thermal conductivity between the cylinder block 11 and the liner upper portion 25. On the other hand, since the thermal conductivity between the cylinder block 11 and the liner lower portion 26 is reduced, the difference between the maximum cylinder wall temperature TWH and the minimum cylinder wall temperature TWL in the engine 1 is reduced.

Hereinafter, a specific method for forming the film 51 will be discussed.

Specifically, the film 51 may be formed through the following procedure.

Figure 8A:
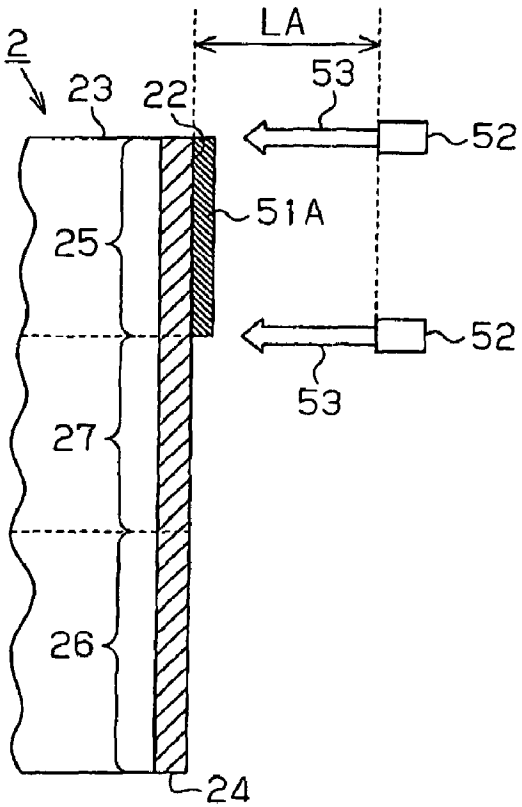

[1] With the spraying distance L set to the reference spraying distance LA, the spraying device 52 is moved from the liner upper end 23 to the boundary between the liner upper portion 25 and the liner middle portion 27, thereby forming the high thermal conductive portion 51A of the film 51 on the liner outer circumferential surface 22 of the liner upper portion 25 (FIG. 8A).

[2] After the spraying device 52 is moved to the boundary between the liner upper portion 25 and the liner middle portion 27, the spraying device 52 is moved to the boundary between the liner middle portion 27 and the liner lower portion 26 while changing the spraying distance L from the reference spraying distance LA to the low-rate spraying distance LB. This forms the inclined film portion 51C of the film 51 on the liner outer circumferential surface 22 of the liner middle portion 27 (FIG. 8B).

[3] After the spraying device 52 is moved to the boundary between the liner middle portion 27 and the liner lower portion 26, the spraying device 52 is moved to the liner lower end 24 with the spraying distance L set at the low-rate spraying distance LB. This forms the low thermal conductive portion 51B of the film 51 on the liner outer circumferential surface 22 of the liner lower portion 26 (FIG. 8C).

Advantages of Embodiment

As described above, in addition to the advantages (5) and (6) of the first embodiment, the cylinder liner and the method for manufacturing the same according to the second embodiment provides the following advantage.

(7) In the cylinder liner 2 of the present embodiment, the low thermal conductive portion 51B of the film 51 is formed on the liner outer circumferential surface 22 of the liner lower portion 26, while the high thermal conductive portion 51A of the film 51 is formed on the liner outer circumferential surface 22 of the liner upper portion 25. Accordingly, the difference between the maximum cylinder wall temperature TWH and the minimum cylinder wall temperature TWL in the engine 1 is reduced. Thus, variation of deformation of each cylinder bore 15 along the axial direction of the cylinder 13 is reduced. Accordingly, deformation amount of deformation of each cylinder bore 15 is equalized. This reduces the friction and thus improves the fuel consumption rate.

(8) In the cylinder liner 2 of the present embodiment, the inclined film portion 51C of the film 51 is formed on the liner outer circumferential surface 22 of the liner middle portion 27. This prevents abrupt changes in the cylinder wall temperature TW in the axial direction of the cylinder 13. Thus, deformation of the cylinder bore 15 is stabilized, and the fuel consumption rate is improved, accordingly.

(9) In the method for manufacturing the cylinder liner 2 according to the present embodiment, the spraying distance L is changed between the reference spraying distance LA and the low-rate spraying distance to form the high thermal conductive portion 51A and the low thermal conductive portion 51B of the film 51. Since the single spraying material 53 is used for forming the film 51, which functions to reduce the cylinder wall temperature difference ΔTW, effort and costs required for the spraying material 53 are reduced.

Modifications of Embodiment

The above illustrated second embodiment may be modified as shown below.

As the material for the film 51, a material that meets at least one of the following conditions (A) and (B) may be used.

(A) A material the melting point of which is lower than or equal to the reference molten metal temperature TC, or a material containing such a material.

(B) A material that can be metallurgically bonded to the casting material of the cylinder block 11, or a material containing such a material.

The method for forming the film 51 according to the second embodiment may be modified as shown below.

[1] With the spraying distance L set to the low-rate spraying distance LB, the spraying device 52 is moved from the liner lower end 24 to the boundary between the liner lower portion 26 and the liner middle portion 27, thereby forming the low thermal conductive portion 51B of the film 51 on the liner outer circumferential surface 22 of the liner lower portion 26.

[2] After the spraying device 52 is moved to the boundary between the liner lower portion 26 and the liner middle portion 27, the spraying device 52 is moved to the boundary between the liner middle portion 27 and the liner upper portion 25 while changing the spraying distance L from the low-rate spraying distance LB to the reference spraying distance LA. This forms the inclined film portion 51C of the film 51 on the liner outer circumferential surface 22 of the liner middle portion 27.

[3] After the spraying device 52 is moved to the boundary between the liner middle portion 27 and the upper lower portion 25, the spraying device 52 is moved to the liner upper end 23 with the spraying distance L set at the reference spraying distance LA. This forms the high thermal conductive portion 51A of the film 51 on the liner outer circumferential surface 22 of the liner upper portion 25.

In the second embodiment, the reference spraying distance LA is determined as the spraying distance L when the deposit efficiency of the spraying material 53 is maximum. However, the reference spraying distance LA may have a different value. In short, as long as the formed high thermal conductive portion 51A increases the thermal conductivity, any value of the spraying distance L may be adopted as the reference spraying distance LA.

Third Embodiment

A third embodiment of the present invention will now be described with reference to FIGS. 9 to 20.

The third embodiment is configured by changing the structure of the cylinder liner according to the first embodiment in the following manner. The cylinder liner according to the third embodiment is the same as that of the first embodiment except for the configuration described below.

<Structure of Cylinder Liner>

Figure 9:
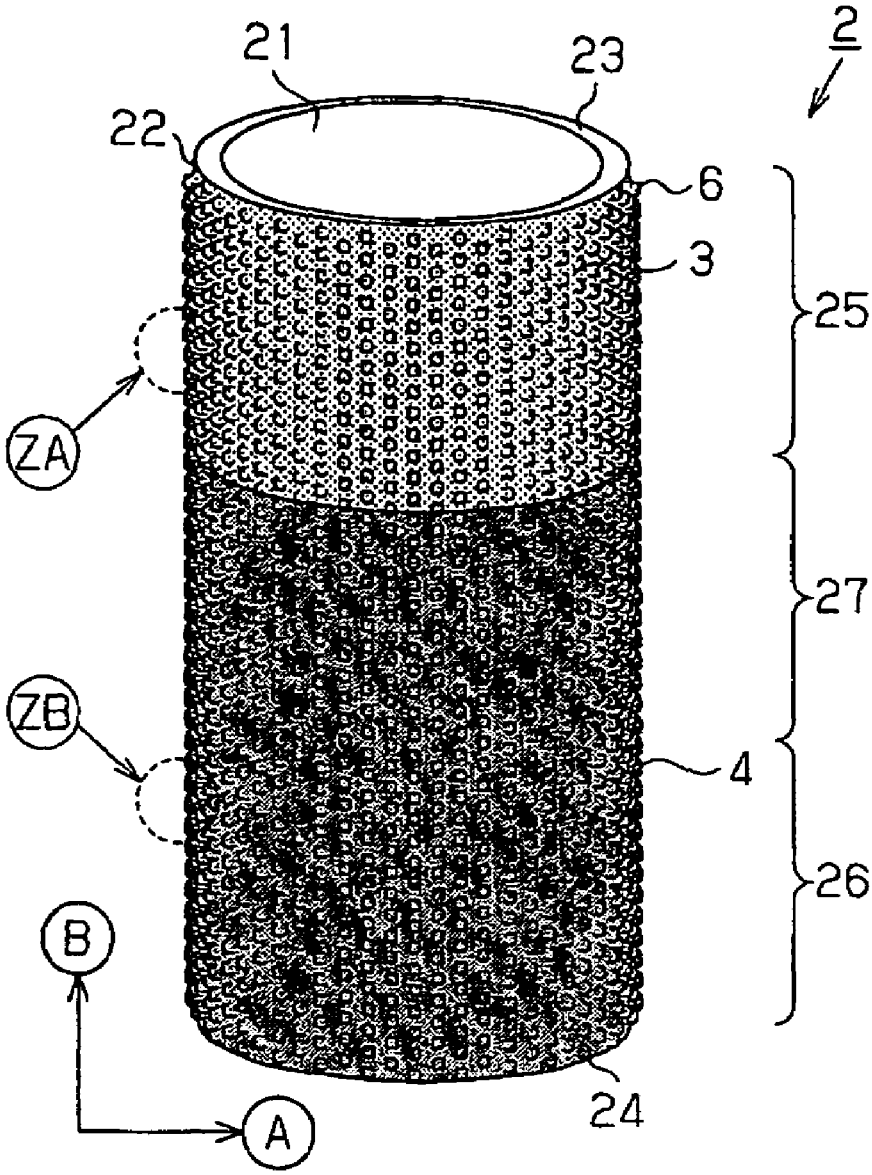
FIG. 9 is a perspective view illustrating a cylinder liner according to a third embodiment of the present invention.

FIG. 9 is a perspective view illustrating the cylinder liner.

Projections 6, each having a constricted shape, are formed on the liner outer circumferential surface 22 of the cylinder liner 2.

The projections 6 are formed on the entire liner outer circumferential surface 22 from an upper end of the cylinder liner 2 (liner upper end 23) to a lower end of the cylinder liner 2 (liner lower end 24).

In the cylinder liner 2, a high thermal conductive film 3 and a low thermal conductive film 4 are formed on the liner outer circumferential surface 22, including the surface of the projections 6.

<Structure of Projection>

Figure 10:
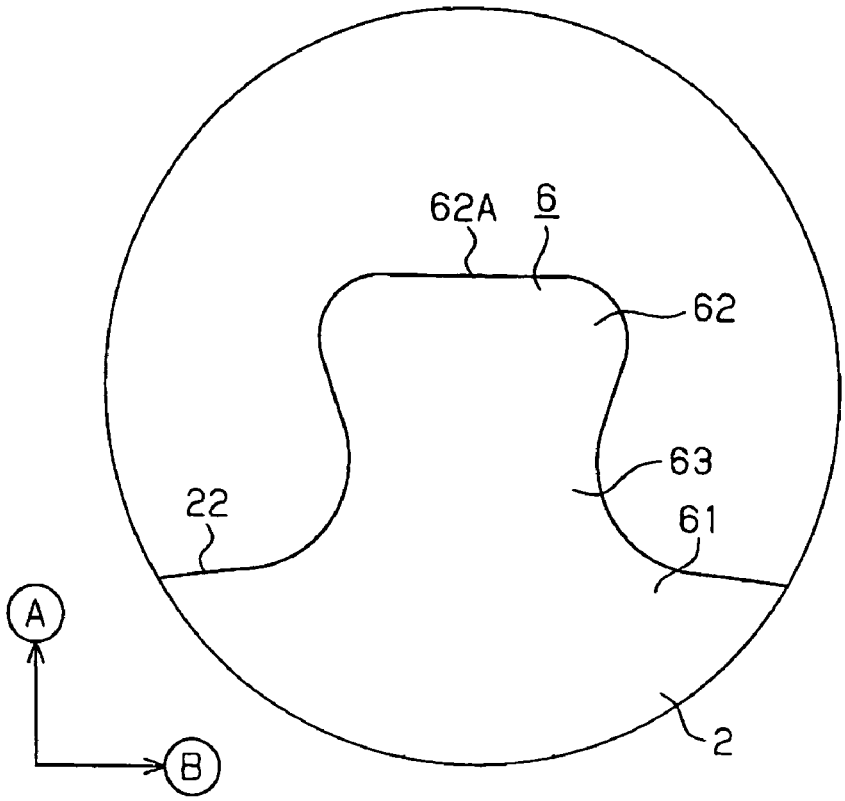
FIG. 10 is a model diagram showing a projection having a constricted shape formed on the cylinder liner of the third embodiment.

FIG. 10 is a model diagram showing a projection 6. Hereafter, a radial direction of the cylinder liner 2 (direction of arrow A) is referred to as an axial direction of the projection 6. Also, the axial direction of the cylinder liner 2 (direction of arrow B) is referred to as a radial direction of the projection 6. FIG. 10 shows the shape of the projection 6 as viewed in the radial direction of the projection 6.

The projection 6 is integrally formed with the cylinder liner 2. The projection 6 is coupled to the liner outer circumferential surface 22 at a proximal end 61.

At a distal end 62 of the projection 6, a top surface 62A that corresponds to a distal end surface of the projection 6 is formed. The top surface 62A is substantially flat.

In the axial direction of the projection 6, a constriction 63 is formed between the proximal end 61 and the distal end 62.

The constriction 63 is formed such that its cross-sectional area along a radial direction (radial direction cross-sectional area SR) is less than a radial direction cross-sectional area SR at the proximal end 61 and at the distal end 62. "Radial direction cross-sectional area" refers to an area of a cross-section perpendicular to the axial direction of the projection 6.

The projection 6 is formed such that the radial direction cross-sectional area SR gradually increases from the constriction 63 to the proximal end 61 and to the distal end 62.

Figure 11:
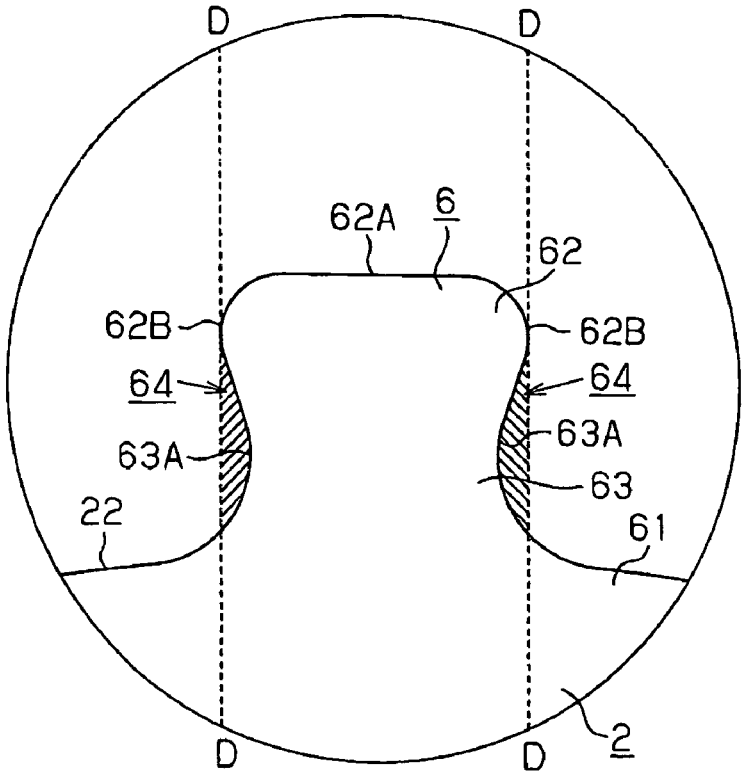
FIG. 11 is a model diagram showing a projection having a constricted shape formed on the cylinder liner of the third embodiment.

FIG. 11 is a model diagram showing the projection 6, in which a constriction space 64 of the cylinder liner 2 is marked.

In each cylinder liner 2, the constriction 63 of each projection 6 creates the constriction space 64 (shaded areas).

The constriction space 64 is a space surrounded by a curved surface that contains a largest distal portion 62B along the axial direction of the projection 6 (in FIG. 11, lines D-D corresponds to the curved surface, which is a cylindrical surface) and the surface of the constriction 63 (constriction surface 63A). The largest distal portion 62B represents a portion at which the radial length of the projection 6 is the longest in the distal end 62.

In the engine 1 having the cylinder liners 2, the cylinder block 11 and the cylinder liners 2 are bonded to each other with part of the cylinder block 11 located in the constriction spaces 64 (the cylinder block 11 being engaged with the projections 6). Therefore, sufficient bond strength of the cylinder block 11 and the cylinder liners 2 (liner bond strength) is ensured. Also, since the increased liner bond strength suppresses deformation of the cylinder bores 15, the friction is reduced. Accordingly, the fuel consumption rate is improved.

<Formation of Films>

In the present embodiment, the high thermal conductive film 3 and the low thermal conductive film 4 are basically formed in accordance with the configuration similar to that of the first embodiment. Also, since the projections 6 are formed on the liner outer circumferential surface 22, the thicknesses of the high thermal conductive film 3 and the low thermal conductive film 4 are determined in the following manner. The thicknesses of the high thermal conductive film 3 and the low thermal conductive film 4 can be measured by using a microscope.

[1] Thickness of High Thermal Conductive Film

In the cylinder liner 2, the high thermal conductive film 3 is formed such that its thickness TP is less than or equal to 0.5 mm. If the film thickness TP is greater than 0.5 mm, the anchor effect of the projections 6 will be reduced, resulting in a significant reduction in the bond strength between the cylinder block 11 and the liner upper portion 25.

In the present embodiment, the high thermal conductive film 3 is formed such that a mean value of the film thickness TP in a plurality of positions of the liner upper portion 25 is less than or equal to 0.5 mm. However, the high thermal conductive film 3 can be formed such that the film thickness TP is less than or equal to 0.5 mm in the entire liner upper portion 25.

[2] Thickness of Low Thermal Conductive Film

In the cylinder liner 2, the low thermal conductive film 4 is formed such that its thickness TP is less than or equal to 0.5 mm. If the film thickness TP is greater than 0.5 mm, the anchor effect of the projections 6 will be reduced, resulting in a significant reduction in the bond strength between the cylinder block 11 and the liner lower portion 26.

In the present embodiment, the low thermal conductive film 4 is formed such that a mean value of the film thickness TP in a plurality of positions of the liner lower portion 26 is less than or equal to 0.5 mm. However, the low thermal conductive film 4 can be formed such that the film thickness TP is less than or equal to 0.5 mm in the entire liner lower portion 26.

<Condition around Projections>

Figure 12:
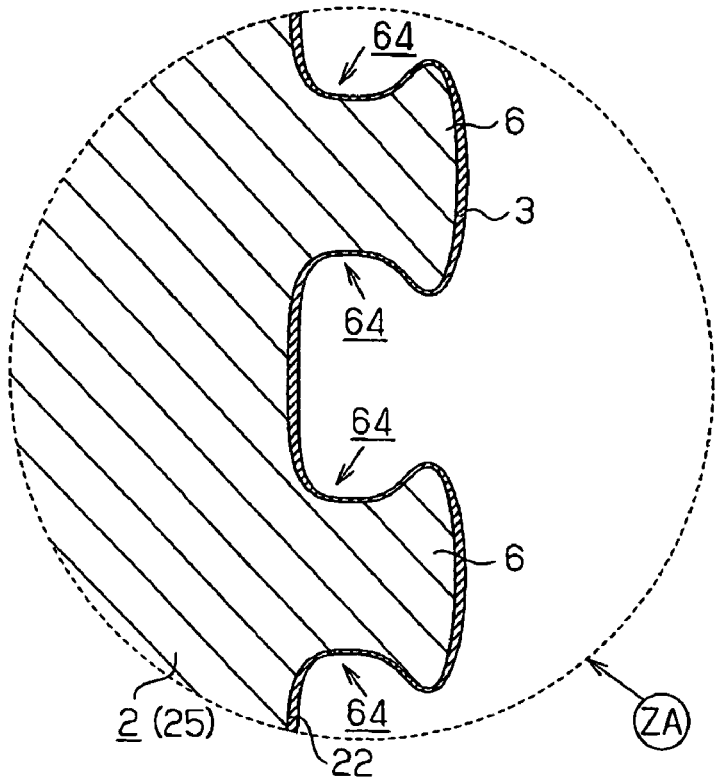
FIG. 12 is an enlarged cross-sectional view of the cylinder liner according to the third embodiment, showing encircled part ZA of FIG. 9.

FIG. 12 shows a cross-sectional structure of encircled part ZD of FIG. 9.

In the cylinder liner 2, the high thermal conductive film 3 is formed on the surfaces of the liner outer circumferential surface 22 and the projections 6. Also, the high thermal conductive film 3 is formed such that the constriction-spaces 64 are not filled. That is, the high thermal conductive film 3 is formed such that, when performing the insert casting of the cylinder liners 2, the casting material fills the constriction spaces 64. If the constriction spaces 64 are filled by the high thermal conductive film 3, the casting material will not fill the constriction spaces 64. Thus, no anchor effect of the projections 6 will be obtained in the liner upper portion 25.

Figure 13:
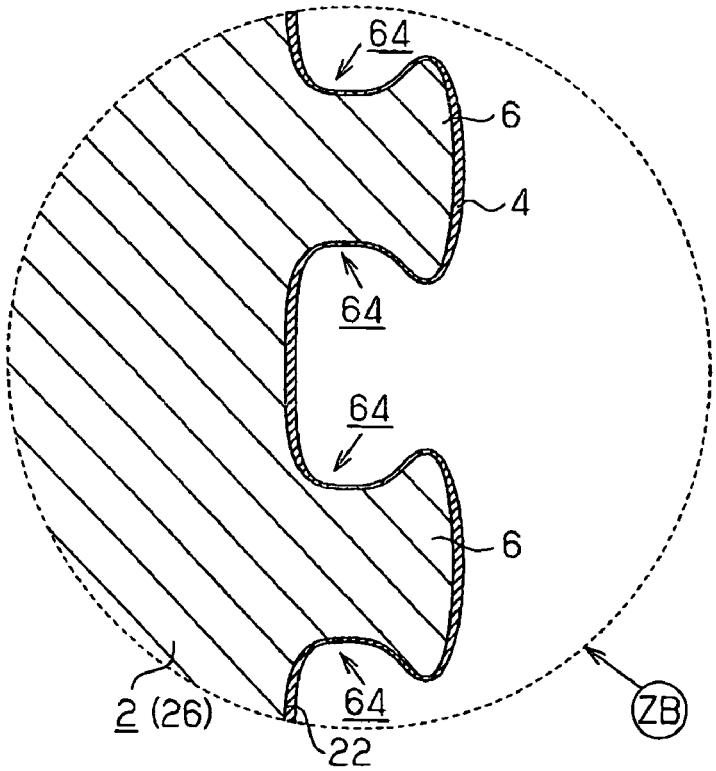
FIG. 13 is an enlarged cross-sectional view of the cylinder liner according to the third embodiment, showing encircled part ZB of FIG. 9.

FIG. 13 shows a cross-sectional structure of encircled part ZB of FIG. 9.

In the cylinder liner 2, the low thermal conductive film 4 is formed on the surfaces of the liner outer circumferential surface 22 and the projections 6. Also, the low thermal conductive film 4 is formed such that the constriction spaces 64 are not filled. That is, the low thermal conductive film 4 is formed such that, when performing the insert casting of the cylinder liners 2, the casting material fills the constriction spaces 64. If the constriction spaces 64 are filled by the low thermal conductive film 4, the casting material will not fill the constriction spaces 64. Thus, no anchor effect of the projections 6 will be obtained in the liner lower portion 26.

<Formation of Projection>

Referring to Table 1, the formation of the projections 6 on the cylinder liner 2 will be described.

As parameters representing the formation state of the projection 6 (formation state parameters), a first area ratio SA, a second area ratio SB, a standard cross-sectional area SD, a standard number of projections NP, and a standard projection length HP are defined.

A measurement height H, a first reference plane PA, and a second reference plane PB, which are basic values for the above formation state parameters, will now be described.

(A) The measurement height H represents the distance from the proximal end of the projection 6 along the axial direction of the projection 6 (the height of the projection 6). At the liner outer circumferential surface 22, i.e. at the proximal end of the projection 6, the measurement height H is 0 mm. At the top surface 62A of the projection 6, the measurement height H has the maximum value.

Figure 18:
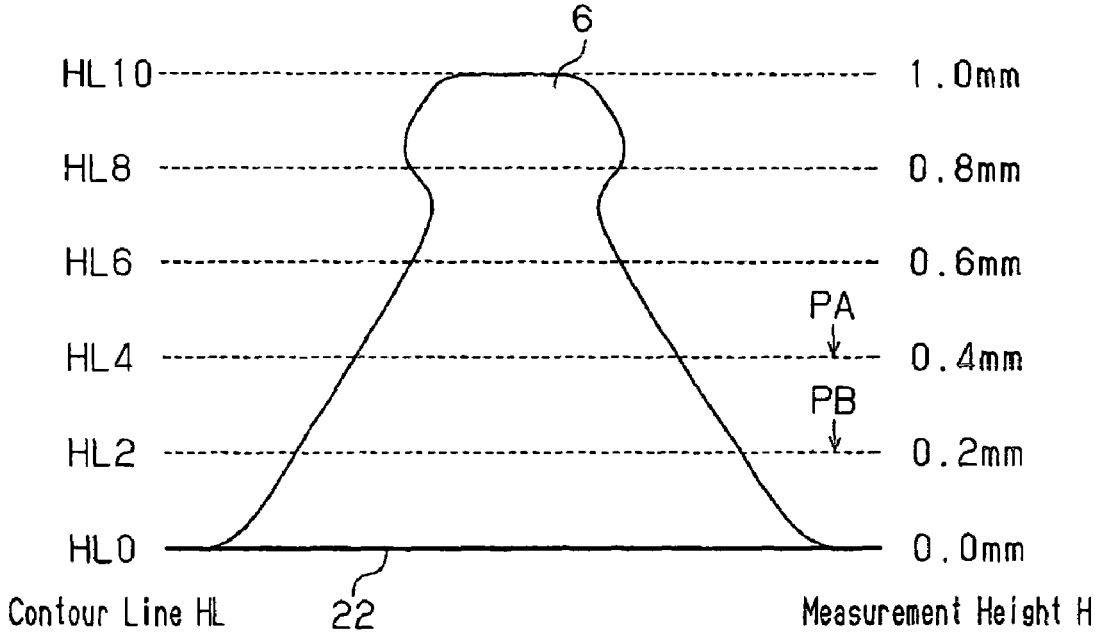
FIG. 18 is a diagram showing the relationship between the measured height and the contour lines of the cylinder liner of the third embodiment.

(B) The first reference plane PA represents a plane that lies along the radial direction of the projection 6 at the position of the measurement height of 0.4 mm (see FIG. 18).

(C) The second reference plane PB represents a plane that lies along the radial direction of the projection 6 at the position of the measurement height of 0.2 mm (see FIG . 18).

The formation state parameters will now be described.

Figure 17:
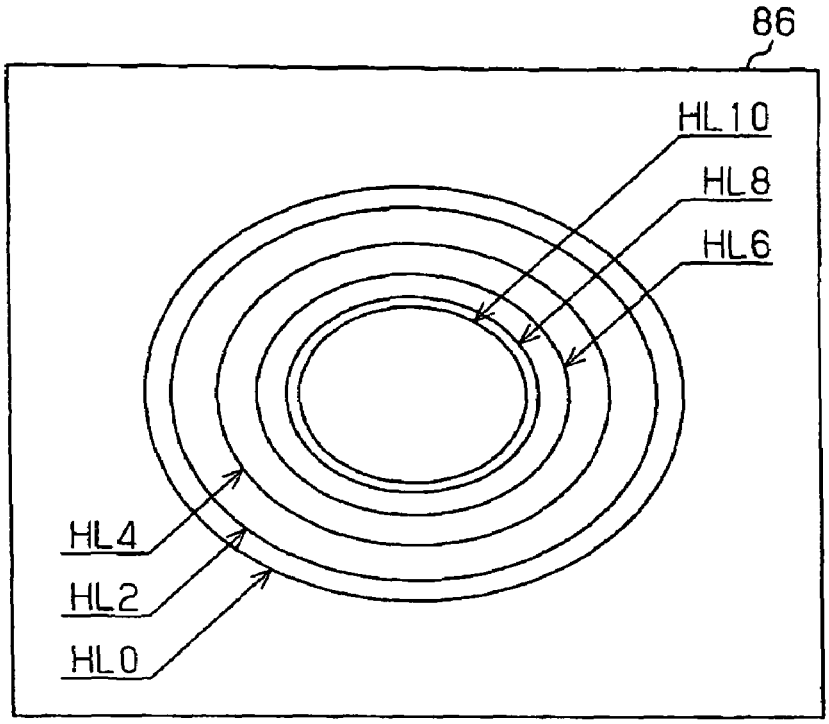
FIG. 17 is a diagram showing contour lines of the cylinder liner according to the third embodiment, obtained through measurement using a three-dimensional laser.
Figure 19:
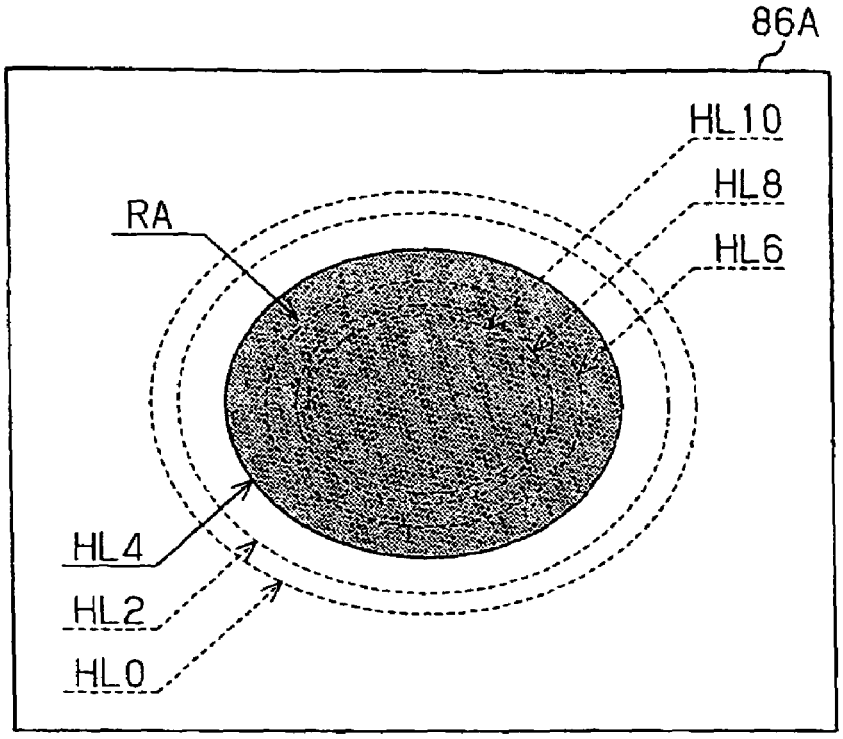
FIG. 19 is a diagram showing contour lines of the cylinder liner according to the third embodiment, obtained through measurement using a three-dimensional laser.

[A] The first area ratio SA represents the ratio of a radial direction cross-sectional area SR of the projection 6 in a unit area of the first reference plane PA. More specifically, the first area ratio SA represents the ratio of the total area of regions RA, which are each surrounded by a contour line HL4 of a height of 0.4 mm, to the area of the entire contour diagram 86 of the liner outer circumferential surface 22 (FIGS. 17 to 19).

Figure 20:
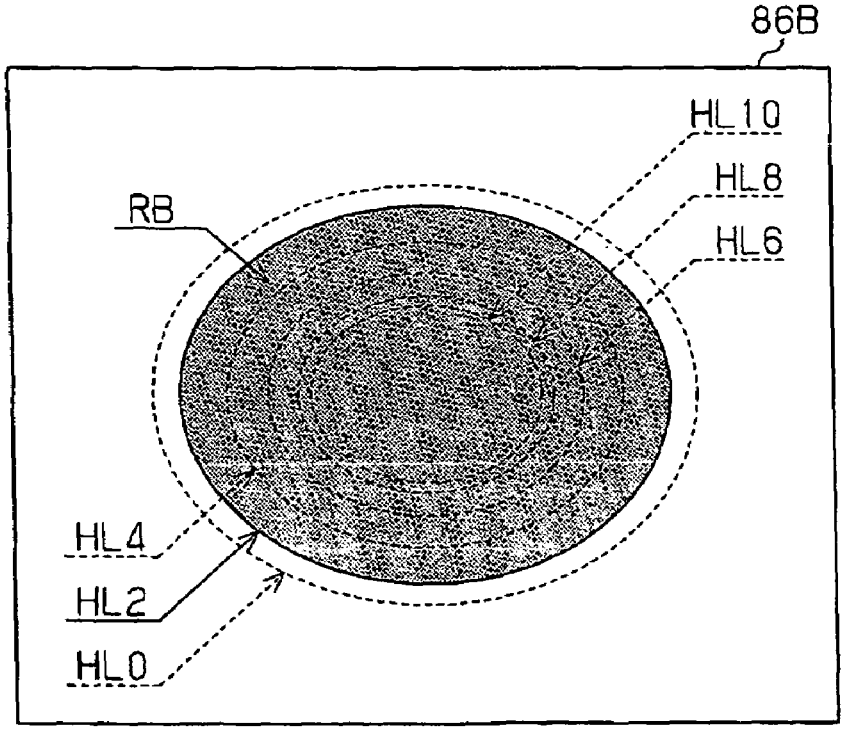
FIG. 20 is a diagram showing contour lines of the cylinder liner according to the third embodiment, obtained through measurement using a three-dimensional laser.

[B] The second area ratio SB represents the ratio of a radial direction cross-sectional area SR of the projection 6 in a unit area of the second reference plane PB. More specifically, the second area ratio SB represents the ratio of the total area of regions RB, which are each surrounded by a contour line HL2 of a height of 0.2 mm, to the area of the entire contour diagram 86 of the liner outer circumferential surface 22 (FIGS. 17, 18 and 20).

[C] The standard cross-sectional area SD represents a radial direction cross-sectional area SR, which is the area of one projection 6 in the first reference plane PA. That is, the standard cross-sectional area SD represents the area of each region RA surrounded by the contour line HL4 of a height of 0.4 mm in the contour diagram 86 of the liner outer circumferential surface 22.

[D] The standard projection number NP represents the number of the projections 6 per unit area in the liner outer circumferential surface 22 (1 $cm^2$).

[E] The standard projection length HP represents a mean value of the values of the measurement height H of the projections 6 at a plurality of positions.

TABLE 1

| | Type of Parameter | Selected Range | Unit |
|---|---|---|---|
| [A] | First area ratio SA | 10 to 50 | [%] |
| [B] | Second Area Ratio SB | 20 to 55 | [%] |
| [C] | Standard Cross-Sectional Area SD | 0.2 to 3.0 | [$mm^2$] |
| [D] | Standard Projection Number NP | 5 to 60 | [number/$cm^2$] |
| [E] | Standard Projection Length HP | 0.5 to 1.0 | [mm] |

In the present embodiment, the formation state parameters [A] to [E] are set to be within the selected ranges in Table 1, so that the liner bond strength of the projections 6 and the filling factor of the casting material between the projections 6 are increased. Since the filling factor of casting material is increased, gaps are unlikely to be created between the cylinder block 11 and the cylinder liners 2. The cylinder block 11 and the cylinder liners 2 are bonded while closing contacting each other.

In the present embodiment, other than setting of the above listed parameters [A] to [E], the cylinder liner 2 is formed such that the projections 6 are each independently formed on the first reference plane PA. This further increases the adhesion.

<Method for Producing Cylinder Liner>

Referring to FIGS. 14 and 15A to 15C and Table 2, a method for producing the cylinder liner 2 will be described.

In the present embodiment, the cylinder liner 2 is produced by centrifugal casting. To make the above listed formation state parameters fall in the selected ranges of Table 1, parameters of the centrifugal casting (the following parameters [A] to [F]) are set be within selected range of Table 2.

[A] The composition ratio of a refractory material 71A in a suspension 71.

[B] The composition ratio of a binder 71B in the suspension 71,

[C] The composition ratio of water 71C in the suspension 71.

[D] The average particle size of the refractory material 71A.

[E] The composition ratio of added surfactant 72 to the suspension 71.

[F] The thickness of a layer of a mold wash 73 (mold wash layer 74).

TABLE 2

| | Type of parameter | Selected range | Unit |
|---|---|---|---|
| [A] | Composition ratio of refractory material | 8 to 30 | [% by mass] |
| [B] | Composition ratio of binder | 2 to 10 | [% by mass] |
| [C] | Composition ratio of water | 60 to 90 | [% by mass] |
| [D] | Average particle size of refractory material | 0.02 to 0.1 | [mm] |
| [E] | Composition ratio of surfactant | $0.005 < x \leqq 0.1$ | [% by mass] |
| [F] | Thickness of mold wash layer | 0.5 to 1.0 | [mm] |

Figure 14:
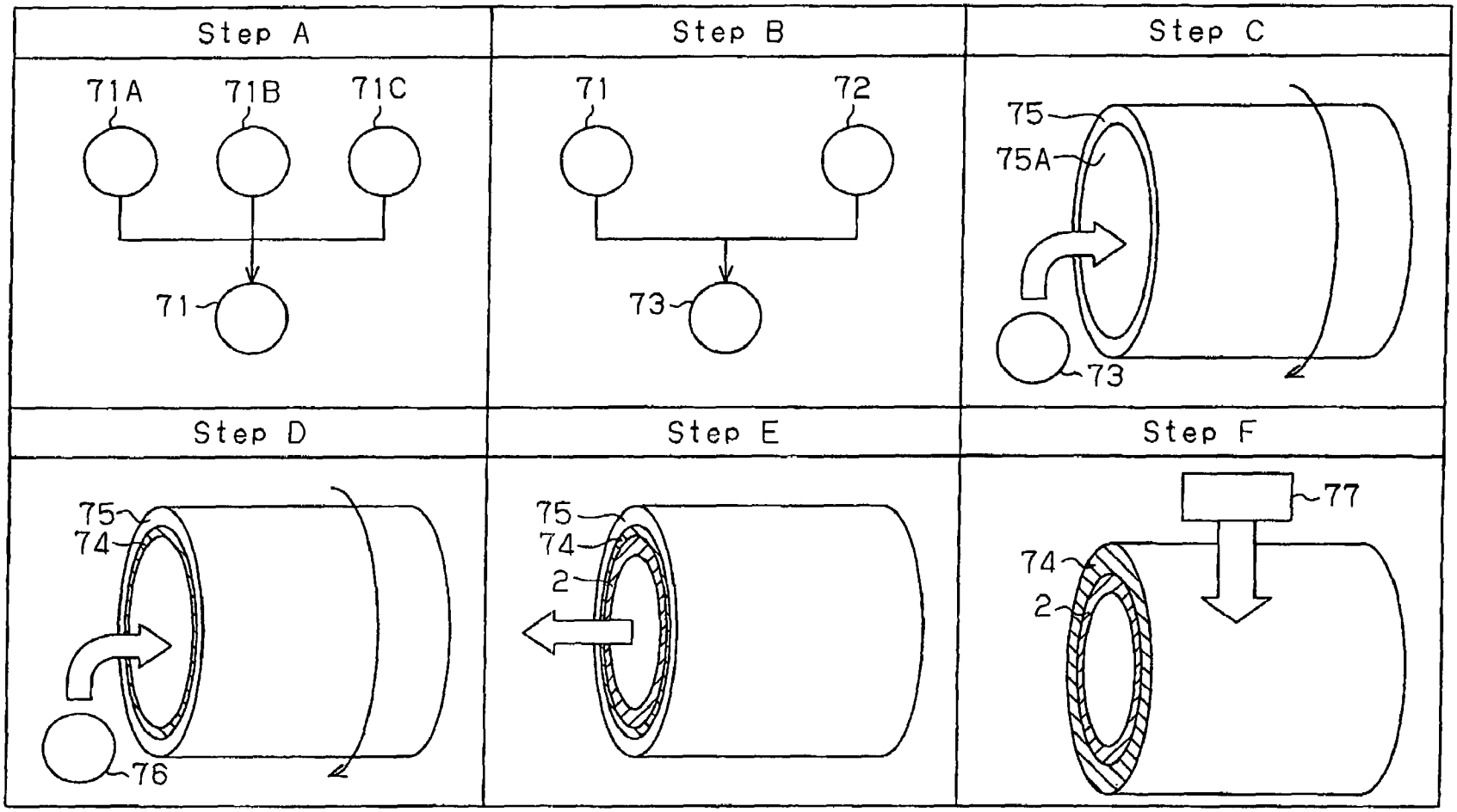
FIG. 14 is a process diagram showing steps for producing a cylinder liner through the centrifugal casting.

The production of the cylinder liner 2 is executed according to the procedure shown in FIG. 14.

[Step A] The refractory material 71A, the binder 71B, and the water 71C are compounded to prepare the suspension 71. In this step, the composition ratios of the refractory material 71A, the binder 71B, and the water 71C, and the average particle size of the refractory material 71A are set to fall within the selected ranges in Table 2.

[Step B] A predetermined amount of the surfactant 72 is added to the suspension 71 to obtain the mold wash 73. In this step, the ratio of the added surfactant 72 to the suspension 71 is set to fall within the selected range shown in Table 2.

[Step C] After heating the inner circumferential surface of a rotating mold 75 to a predetermined temperature, the mold wash 73 is applied through spraying on an inner circumferential surface of the mold 75 (mold inner circumferential surface 75A). At this time, the mold wash 73 is applied such that a layer of the mold wash 73 (mold wash layer 74) of a substantially-uniform thickness is formed on the entire mold inner circumferential surface 75A. In this step, the thickness of the mold wash layer 74 is set to fall within the selected range shown in Table 2.

In the mold wash layer 74 of the mold 75, holes having a constricted shape are formed after [Step C].

Figure 15A:
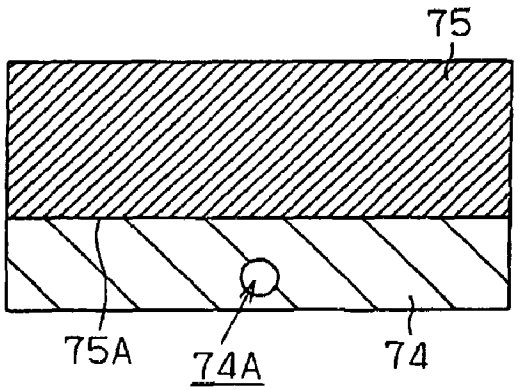
FIGS. 15A to 15C are process diagrams showing steps for forming a recess having a constricted shape in a mold wash layer in the production of the cylinder liner through the centrifugal casting.
Figure 15B:
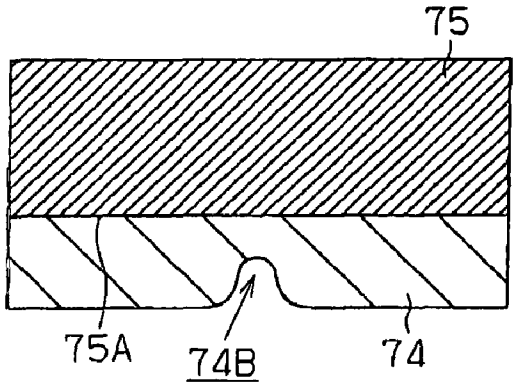
Figure 15C:
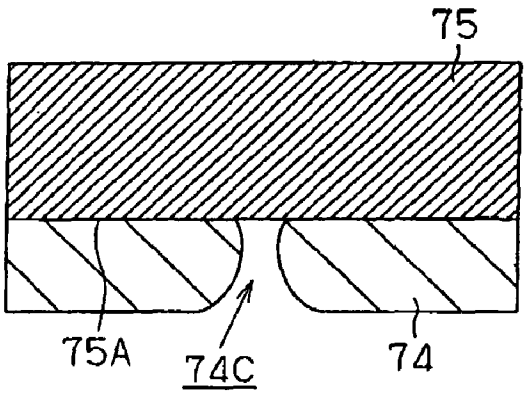

Referring to FIGS. 15A to 15C, the formation of the holes having a constricted shape will be described.

[1] The mold wash layer 74 with a plurality of bubbles 74A is formed on the mold inner circumferential surface 75A of the mold 75 (FIG. 15A).

[2] The surfactant 72 acts on the bubbles 74A to form recesses 74B in the inner circumferential surface of the mold wash layer 74 (FIG. 15B).

[3] The bottom of the recess. 74B reaches the mold inner circumferential surface 75A, so that a hole 74C having a constricted shape is formed in the mold wash layer 74 (FIG. 15C).

[Step D] After the mold wash layer 74 is dried, molten metal 76 of cast iron is poured into the mold 75, which is being rotated. The molten metal 76 flows into the hole 74C having a constricted shape in the mold wash layer 74. Thus, the projections 6 having a constricted shape are formed on the cast cylinder liner 2.

[Step E] After the molten metal 76 is hardened and the cylinder liner 2 is formed, the cylinder liner 2 is taken out of the mold 75 with the mold wash layer 74. [Step F] Using a blasting device 77, the mold wash layer 74 (mold wash 73) is removed from the outer circumferential surface of the cylinder liner 2.

<Method for Measuring Formation State Parameters>

Figure 16B:
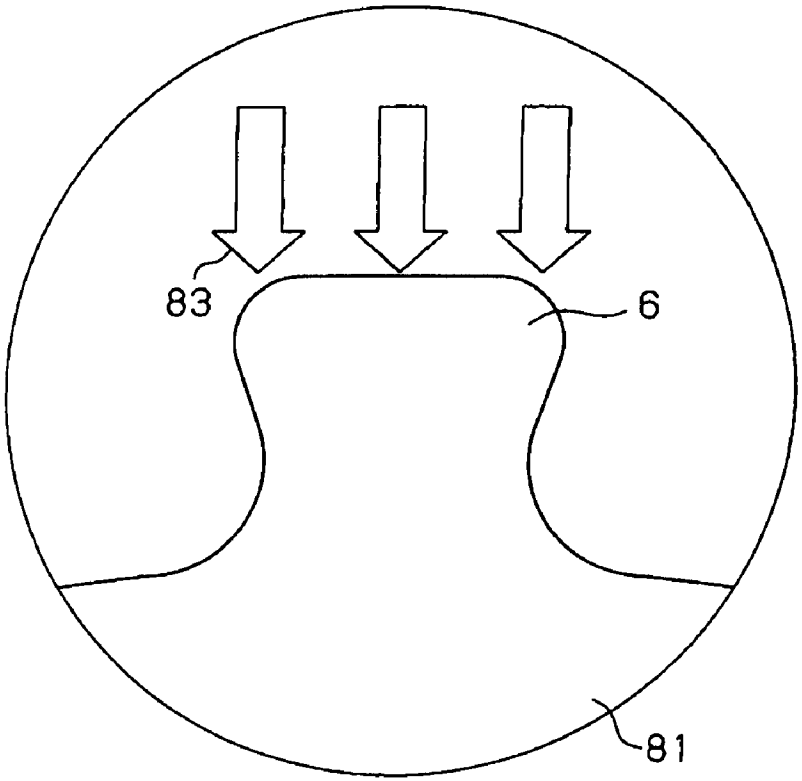
FIGS. 16A and 16B are diagrams showing one example of the procedure for measuring parameters of the cylinder liner according to the third embodiment, using a three-dimensional laser.
Figure 16A:
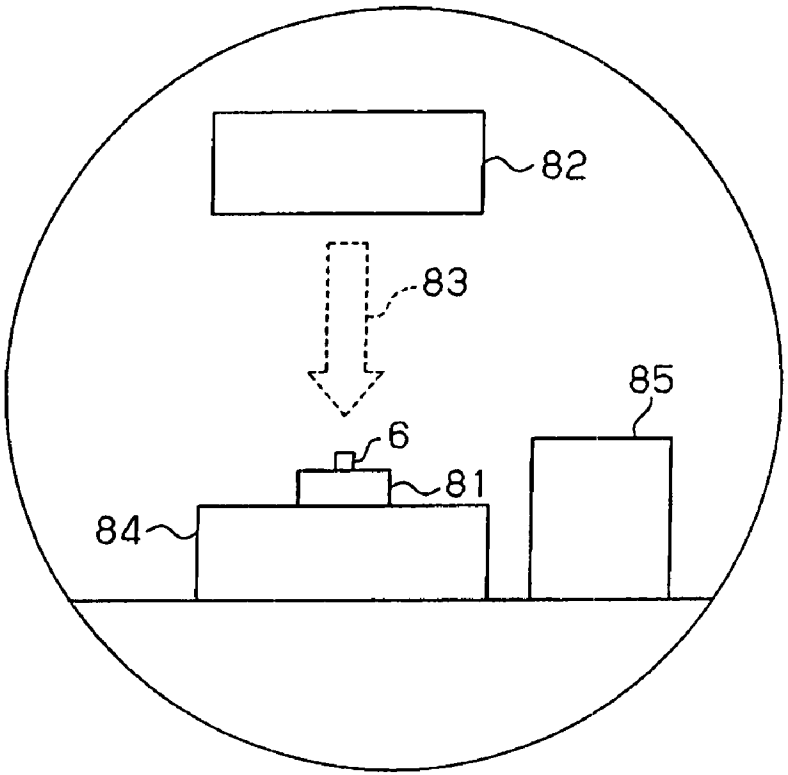

Referring to FIGS. 16A and 16B, a method for measuring the formation state parameters using a three-dimensional laser will be described. The standard projection length HP is measured by another method.

Each of the formation state parameters can be measured in the following manner.

[1] A test piece 81 for measuring parameters of projections is made from the cylinder liner 2.

[2] In a noncontact three-dimensional laser measuring device 82, the test piece 81 is set on a test bench 84 such that the axial direction of the projections 6 is substantially parallel to the irradiation direction of laser light 83 (FIG. 16A).

[3] The laser light 83 is irradiated from the three-dimensional laser measuring device 82 to the test piece 81 (FIG. 16B).

[4] The measurement results of the three-dimensional laser measuring device 82 are imported into an image processing device 85.

[5] Through the image processing performed by the image processing device 85, a contour diagram 86 (FIG. 17) of the liner outer circumferential surface 22 is displayed. The formation state parameters are computed based on the contour diagram 86.

<Contour Lines of Liner Outer Circumferential Surface>

Referring to FIGS. 17 and 18, the contour diagram 86 of the liner outer circumferential surface 22 will be explained. FIG. 17 is one example of the contour diagram 86. FIG. 18 shows the relationship between the measurement height H and contour lines HL. The contour diagram 86 of FIG. 17 shows a different projection 6 from that shown in FIG. 18.

In the contour diagram 86, the contour lines HL are shown at every predetermined value of the measurement height H.

For example, in the case where the contour lines HL are shown at a 0.2 mm interval from the measurement height of 0 mm to the measurement height of 1.0 mm in the contour diagram 86, contour lines HL0 of the measurement height of 0 mm, contour lines HL2 of the measurement height of 0.2 mm, contour lines HL4 of the measurement height of 0.4 mm, contour lines HL6 of the measurement height of 0.6 mm, contour lines HL8 of the measurement height of 0.8 mm, and contour lines HL10 of the measurement height of 1.0 mm are shown.

In FIG. 18, the contour line HL 4 corresponds to the first reference plane PA. Also, the contour line HL 2 corresponds to the second reference plane PB. Although a diagram is shown in which the contour lines HL are shown at a 0.2 mm interval, the distance between the contour lines HL may be changed as necessary in the actual contour diagram 86.

Referring to FIGS. 19 and 20, first regions RA and second regions RB in the contour diagram 86 will be described. FIG. 19 is a contour diagram 86 (first contour diagram 86A) in which the contour lines other than the contour lines HL4 of the measurement height 0.4 mm are shown in dotted lines. FIG. 20 is a contour diagram 86 (second contour diagram 86B) in which the contour lines other than the contour lines HL2 of the measurement height 0.2 mm are shown in dotted lines. In FIGS. 19 and 20, solid lines represent the shown contour lines HL, broken lines represent the other contour lines HL.

In the present embodiment, regions each surrounded by the contour line HL4 in the contour diagram 86 are defined as the first regions RA. That is, the shaded areas in the first contour diagram 86A correspond to the first regions RA. Regions each surrounded by the contour line HL2 in the contour diagram 86 are defined as the second regions RB. That is, the shaded areas in the second contour diagram 86B correspond to the second regions RB.

<Method for Computing Formation State Parameters>

As for the cylinder liner 2 according to the present embodiment, the formation state parameters are computed in the following manner based on the contour diagram 86.

[A] First Area Ratio SA

The first area ratio SA is computed as the ratio of the total area of the first regions RA to the area of the entire contour diagram 86. That is, the first area ratio SA is computed by using the following formula.

$$SA=SRA/ST\times 100[\%]$$

In the above formula, the symbol ST represents the area of the entire contour diagram 86. The symbol SRA represents the total area obtained by adding up the area of the first region RA in the contour diagram 86. For example, when the first contour diagram 86A of FIG. 19 is used as a model, the area of the rectangular zone corresponds to the area ST. The area of the shaded zone corresponds to the area SRA. When computing the first area ratio SA, the contour diagram 86 is assumed to include only the liner outer circumferential surface 22.

[B] Second Area Ratio SB

The second area ratio SB is computed as the ratio of the total area of the second regions RB to the area of the entire contour diagram 86. That is, the second area ratio SB is computed by using the following formula.

$$SB=SRB/ST\times 100[\%]$$

In the above formula, the symbol ST represents the area of the entire contour diagram 86. The symbol SRB represents the total area obtained by adding up the area of the second region RB in the contour diagram 86. For example, when the second contour diagram 86B of FIG. 20 is used as a model, the area of the rectangular zone corresponds to the area ST. The area of the shaded zone corresponds to the area SRB. When computing the second area ratio SB, the contour diagram 86 is assumed to include only the liner outer circumferential surface 22.

[C] Standard Cross-sectional Area SD

The standard cross-sectional area SD can be computed as the area of each first region RA in the contour diagram 86. For example, when the first contour diagram 86A of FIG. 19 is used as a model, the area of the shaded area corresponds to the standard cross-sectional area SD.

[D] Standard Projection Number NP

The standard projection number NP can be computed as the number of projections 6 per unit area in the contour diagram 86 (in this embodiment, 1 $cm^2$). For example, when the first contour diagram 86A of FIG. 19 or the second contour diagram 86B of FIG. 20 is used as a model, the number of projection in each drawing (one) corresponds to the standard projection number NP. In the cylinder liner 2 of the present embodiment, five to sixty projections 6 are formed per unit area (1 $cm^2$) Thus, the actual standard projection number NP is different from the reference projection numbers of the first contour diagram 86A and the second contour diagram 86B.

[E] Standard Projection Length HP

The standard projection length HP can be computed as a mean value of the heights of the projections 6 at one or more locations. The height of the projections 6 can be measured by a measuring device such as a dial depth gauge.

Whether the projections 6 are independently provided on the first reference plane PA can be checked based on the first regions RA in the contour diagram 86. That is, when the first region RA does not interfere with other first regions RA, it is confirmed that the projections 6 are independently provided on the first reference plane PA.

Advantages of Embodiment

In addition to the advantages (1) to (6) in the first embodiment, the cylinder liner and the engine according to the present embodiment provide the following advantage.

(10) In the cylinder liner 2 of the present embodiment, the projections 6 are formed on the liner outer circumferential surface 22. This permits the cylinder block 11 and cylinder liner 2 to be bonded to each other with the cylinder block 11 and the projections 6 engaged with each other. Sufficient bond strength between the cylinder block 11 and the cylinder liner 2 is ensured. Such increase in the bond strength prevents exfoliation between the cylinder block 11 and the high thermal conductive film 3 and between the cylinder block 11 and the low thermal conductive film 4. The effect of increase and reduction of thermal conductivity obtained by the films is reliably maintained. Also, the increase in the bond strength prevents the cylinder bore 15 from being deformed.

(11) In the cylinder liner 2 of the present embodiment, the high thermal conductive film 3 is formed such that its thickness TP is less than or equal to 0.5 mm. This prevents the bond strength between the cylinder block 11 and the liner upper portion 25 from being lowered.

(12) In the cylinder liner 2 of the present embodiment, the low thermal conductive film 4 is formed such that its thickness TP is less than or equal to 0.5 mm. This prevents the bond strength between the cylinder block 11 and the liner lower portion 26 from being lowered.

(13) In the cylinder liner 2 of the present embodiment, the projections 6 are formed such that the standard projection number NP is in the range from five to sixty. This further increases the liner bond strength. Also, the filling factor of the casting material to spaces between the projections 6 is increased.

If the standard projection number NP is out of the selected range, the following problems will be caused. If the standard projection number NP is less than five, the number of the projections 6 will be insufficient. This will reduce the liner bond strength. If the standard projection number NP is more than sixty, narrow spaces between the projections 6 will reduce the filing factor of the casting material to spaces between the projections 6.

(14) In the cylinder liner 2 of the present embodiment, the projections 6 are formed such that the standard projection length HP is in the range from 0.5 mm to 1.0 mm. This increases the liner bond strength and the accuracy of the outer diameter of the cylinder liner 2.

If the standard projection length HP is out of the selected range, the following problems will be caused. If the standard projection length HP is less 0.5 mm, the height of the projections 6 will be insufficient. This will reduce the liner bond strength. If the standard projection length HP is more 1.0 mm, the projections 6 will be easily broken. This will also reduce the liner bond strength. Also, since the heights of the projection 6 are uneven, the accuracy of the outer diameter is reduced.

(15) In the cylinder liner 2 of the present embodiment, the projections 6 are formed such that the first area ratio SA is in the range from 10% to 50%. This ensures sufficient liner bond strength. Also, the filling factor of the casting material to spaces between the projections 6 is increased.

If the first area ratio SA is out of the selected range, the following problems will be caused. If the first area ratio SA is less than 10%, the liner bond strength will be significantly reduced compared to the case where the first area ratio SA is more than or equal to 10%. If the first area ratio SA is more than 50%, the second area ratio SB will surpass the upper limit value (55%). Thus, the filling factor of the casting material in the spaces between the projections 6 will be significantly reduced.

(16) In the cylinder liner 2 of the present embodiment, the projections 6 are formed such that the second area ratio SB is in the range from 20% to 55%. This increases the filling factor of the casting material to spaces between projections 6. Also, sufficient liner bond strength is ensured.

If the second area ratio SB is out of the selected range, the following problems will be caused. If the second area ratio SB is less than 20%, the first area ratio SA will fall below the lower limit value (10%). Thus, the liner bond strength will be significantly reduced. If the second area ratio SB is more than 55%, the filling factor of the casting material in the spaces between the projections 6 will be significantly reduced compared to the case where the second area ratio SB is less than or equal to 55%.

(17) In the cylinder liner 2 of the present embodiment, the projections 6 are formed such that the standard cross-sectional area SD is in the range from 0.2 $mm^2$ to 3.0 $mm^2$. Thus, during the producing process of the cylinder liners 2, the projections 6 a prevented from being damaged. Also, the filling factor of the casting material to spaces between the projections 6 is increased.

If the standard cross-sectional area SD is out of the selected range, the following problems will be caused. If the standard cross-sectional area SD is less than 0.2 $mm^2$, the strength of the projections 6 will be insufficient, and the projections 6 will be easily damaged during the production of the cylinder liner 2. If the standard cross-sectional area SD is more than 3.0 $mm^2$, narrow spaces between the projections 6 will reduce the filing factor of the casting material to spaces between the projections 6.

(18) In the cylinder liner 2 of the present embodiment, the projections 6 (the first areas RA) are formed to be independent from one another on the first reference plane PA. This increases the filling factor of the casting material to spaces between projections 6. If the projections 6 (the first areas RA) are not independent from one another in the first reference plane PA, narrow spaces between the projections 6 will reduce the filing factor of the casting material to spaces between the projections 6.

Modifications of Embodiment

The above illustrated third embodiment may be modified as shown below.

The configuration of the third embodiment may be applied to the cylinder liner 2 of the second embodiment.

In the third embodiment, the selected ranges of the first area ratio SA and the second area ratio SB are set to be in the selected ranges shown in Table 1. However, the selected ranges may be changed as shown below.

The first area ratio SA: 10% to 30%

The second area ratio SB: 20% to 45%

This setting increases the liner bond strength and the filling factor of the casting material to the spaces between the projections 6.

In the third embodiment, the high thermal conductive film 3 and the low thermal conductive film 4 are formed on the cylinder liner 2 with the projections 6 the formation parameters of which are in the selected ranges of Table 1. However, the high thermal conductive film 3 and the low thermal conductive film 4 may be formed on any cylinder liner as long as the projections 6 are formed on it.

Other Embodiments

The above embodiments may be modified as follows.

In the above embodiment, the cylinder liner of the present embodiment is applied to an engine made of an aluminum alloy. However, the cylinder liner of the present invention may be applied to an engine made of, for example, a magnesium alloy. In short, the cylinder liner of the present invention may be applied to any engine that has a cylinder liner. Even in such case, the advantages similar to those of the above embodiments are obtained if the invention is embodied in a manner similar to the above embodiments.

The invention claimed is:

1. A cylinder liner for insert casting used in a cylinder block, the cylinder liner having an outer circumferential surface, and upper, middle, and lower portions with respect to an axial direction of the cylinder liner, wherein a high thermal conductive film is formed on the outer circumferential surface to extend from the upper portion to the middle portion but not to extend over the lower portion, and a low thermal conductive film is formed on the outer circumferential surface to extend from the lower portion to the middle portion but not to extend over the upper portion, and wherein the high thermal conductive film and the low thermal conductive film are laminated in a section of the outer circumferential surface that corresponds to the middle portion, thereby forming a laminated film portion.

2. The cylinder liner according to claim 1, wherein, in the laminated film portion, the high thermal conductive film has a thickness that is gradually reduced from the upper portion toward the lower portion.

3. The cylinder liner according to claim 1, wherein, in the laminated film portion, the low thermal conductive film has a thickness that is gradually reduced from the lower portion toward the upper portion.

4. The cylinder liner according to claim 1, wherein the high thermal conductive film functions to increase adhesion of the cylinder liner to the cylinder block.

5. The cylinder liner according to claim 1, wherein the high thermal conductive film is metallurgically bonded to the cylinder block.

6. The cylinder liner according to claim 1, wherein the high thermal conductive film has a melting point that is lower than or equal to a temperature of a molten casting material used in the insert casting of the cylinder liner with the cylinder block.

7. The cylinder liner according to claim 1, wherein the high thermal conductive film has a higher thermal conductivity than that of the cylinder liner.

8. The cylinder liner according to claim 1, wherein the high thermal conductive film has a higher thermal conductivity than that of the cylinder block.

9. The cylinder liner according to claim 1, wherein the low thermal conductive film functions to form gaps between the cylinder block and the cylinder liner.

10. A cylinder liner for insert casting used in a cylinder block, the cylinder liner having an outer circumferential surface, and upper, middle, and lower portions with respect to an axial direction of the cylinder liner, wherein a high thermal conductive film is formed on the outer circumferential surface to extend from the upper portion to the middle portion but not to extend over the lower portion, and a low thermal conductive film is formed on the outer circumferential surface to extend from the lower portion to the middle portion but not to extend over the upper portion, and wherein the high thermal conductive film and the low thermal conductive film are laminated in a section of the outer circumferential surface that corresponds to the middle portion, thereby forming a laminated film portion, wherein the low thermal conductive film functions to lower the adhesion of the cylinder liner to the cylinder block.

11. The cylinder liner according to claim 1, wherein the low thermal conductive film has a lower thermal conductivity than that of the cylinder block.

12. The cylinder liner according to claim 1, wherein the low thermal conductive film has a lower thermal conductivity than that of the cylinder liner.

13. The cylinder liner according to claim 1, wherein the outer circumferential surface has a plurality of projections each having a constricted shape.

14. The cylinder liner according to claim 13, wherein the number of the projections is five to sixty per $cm^2$ of the outer circumferential surface.

15. The cylinder liner according to claim 13, wherein the height of each projection is 0.5 to 1.0 mm.

16. The cylinder liner according to claim 13, wherein the projections are arranged and formed such that, in a contour diagram of the outer circumferential surface obtained by a three-dimensional laser measuring device, the ratio of the total area of regions each surrounded by a contour line representing a height of 0.4 mm to the area of the entire contour diagram is equal to or more than 10%.

17. The cylinder liner according to claim 13, wherein the projections are arranged and formed such that, in a contour diagram of the outer circumferential surface obtained by a three-dimensional laser measuring device, the ratio of the total area of regions each surrounded by a contour line representing a height of 0.2 mm to the area of the entire contour diagram is equal to or less than 55%.

18. The cylinder liner according to claim 13, wherein the projections are arranged and formed such that, in a contour diagram of the outer circumferential surface obtained by a three-dimensional laser measuring device, the ratio of the total area of regions each surrounded by a contour line representing a height of 0.4 mm to the area of the entire contour diagram is 10 to 50%.

19. The cylinder liner according to claim 13, wherein the projections are arranged and formed such that, in a contour diagram of the outer circumferential surface obtained by a three-dimensional laser measuring device, the ratio of the total area of regions each surrounded by a contour line representing a height of 0.2 mm to the area of the entire contour diagram is 20 to 55%.

20. The cylinder liner according to claim 13, wherein the projections are formed such that, in a contour diagram of the outer circumferential surface obtained by a three-dimensional laser measuring device, the area of each region surrounded by a contour line representing a height of 0.4 mm is 0.2 to 3.0 $mm^2$.

21. The cylinder liner according to claim 13, wherein the projections are arranged and formed such that, in a contour diagram of the outer circumferential surface obtained by a three-dimensional laser measuring device, regions each surrounded by a contour line representing a height of 0.4 mm are independent from one another.

22. The cylinder liner according to claim 1, wherein a thickness of the laminated film portion is substantially equal to a thickness of the high thermal conductive film and a thickness of the low thermal conductive film.

23. The cylinder liner according to claim 10, wherein a thickness of the laminated film portion is substantially equal to a thickness of the high thermal conductive film and a thickness of the low thermal conductive film.

* * * * *

UNITED STATES PATENT AND TRADEMARK OFFICE

CERTIFICATE OF CORRECTION

PATENT NO. : 7,685,987 B2
APPLICATION NO. : 11/480873
DATED : March 30, 2010
INVENTOR(S) : Noritaka Miyamoto et al.

It is certified that error appears in the above-identified patent and that said Letters Patent is hereby corrected as shown below:

| Column | Line | |
|---|---|---|
| 5 | 7 | Change "FIGS. 6A and GB" to --FIGS. 6A and B--. |
| 7 | 48 | After "and the" delete "liner". |
| 10 | 32 | Change "an ceramic" to --a ceramic--. |
| 10 | 35 | Change "pores" to --ores--. |
| 16 | 47 | After "adjacent" delete "the". |
| 16 | 49 | Delete "is prevented"; after "from" insert --being--. |
| 16 | 66 | After "adjacent" delete "the". |
| 18 | 9 | Change "finishes" to --finished--. |
| 24 | 52 | After "recess" delete ".". |
| 24 | 64 | After "layer **74**." start new paragraph. |
| 26 | 54 | Change "projection" to --projections--. |
| 28 | 37 | Change "a prevented" to --are prevented--. |

Signed and Sealed this

Fifteenth Day of June, 2010

David J. Kappos

David J. Kappos
*Director of the United States Patent and Trademark Office*